US009755298B2

(12) United States Patent
Choi et al.

(10) Patent No.: US 9,755,298 B2
(45) Date of Patent: Sep. 5, 2017

(54) ANTENNA MODULE AND MOBILE TERMINAL HAVING THE SAME

(71) Applicant: LG ELECTRONICS INC., Seoul (KR)

(72) Inventors: Hyengcheul Choi, Seoul (KR); Jaehyun Choi, Seoul (KR); Chisang You, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 58 days.

(21) Appl. No.: 14/871,745

(22) Filed: Sep. 30, 2015

(65) Prior Publication Data

US 2016/0197396 A1 Jul. 7, 2016

(30) Foreign Application Priority Data

Jan. 5, 2015 (KR) ..... 10-2015-0000775

(51) Int. Cl.
*H01Q 1/24* (2006.01)
*H01Q 1/48* (2006.01)
(Continued)

(52) U.S. Cl.
CPC ..... *H01Q 1/243* (2013.01); *H01Q 1/48* (2013.01); *H01Q 1/521* (2013.01); *H01Q 5/314* (2015.01);
(Continued)

(58) Field of Classification Search
CPC ..... H01Q 1/243; H01Q 1/521; H01Q 9/42; H01Q 5/314; H01Q 1/48; H01Q 5/35; H01Q 21/28; H01Q 7/00
(Continued)

(56) References Cited

U.S. PATENT DOCUMENTS

2011/0248895 A1* 10/2011 Bungo ..... H01Q 1/243 343/702
2013/0069836 A1* 3/2013 Bungo ..... H01Q 1/243 343/724
(Continued)

FOREIGN PATENT DOCUMENTS

EP 2498336 A2 9/2012
EP 2562870 A1 2/2013
(Continued)

OTHER PUBLICATIONS

European Patent Office, Search Report issued in Application No. EP 15002778.7, Jun. 1, 2016, 9 pages.

*Primary Examiner* — Hoang Nguyen
(74) *Attorney, Agent, or Firm* — Lee, Hong, Degerman, Kang & Waimey

(57) ABSTRACT

Disclosed are an antenna module and a mobile terminal having the same. The antenna module including a ground plate; a metal plate spaced apart from the ground plate by a distance such that a surface of the ground plate faces a surface of the metal plate; and at least one feeding part and at least one ground part that couple the ground plate to the metal plate, wherein the at least one ground part may include a first ground part and a second ground part that are formed at two different positions along an edge of the ground plate, and wherein the first ground part and the second ground part may be spaced apart from the at least one feeding part.

24 Claims, 21 Drawing Sheets

(51) Int. Cl.

| | |
|---|---|
| ***H01Q 1/52*** | (2006.01) |
| ***H01Q 7/00*** | (2006.01) |
| ***H01Q 9/42*** | (2006.01) |
| ***H01Q 21/28*** | (2006.01) |
| ***H01Q 5/314*** | (2015.01) |
| ***H01Q 5/35*** | (2015.01) |

(52) U.S. Cl.
CPC ..... *H01Q 5/35* (2015.01); *H01Q 7/00* (2013.01); *H01Q 9/42* (2013.01); *H01Q 21/28* (2013.01)

(58) Field of Classification Search
USPC ..... 343/702, 846, 848
See application file for complete search history.

(56) References Cited

U.S. PATENT DOCUMENTS

2013/0194143 A1* 8/2013 Bungo ..... H01Q 21/28
343/725
2015/0084817 A1* 3/2015 Yong ..... H01Q 1/243
343/702

FOREIGN PATENT DOCUMENTS

EP 2573867 A1 3/2013
WO 2014/199861 A1 12/2014

* cited by examiner

ANTENNA MODULE AND MOBILE TERMINAL HAVING THE SAME

CROSS-REFERENCE TO RELATED APPLICATIONS

Pursuant to 35 U.S.C. §119(a), this application claims the benefit of earlier filing date and right of priority to Korean Application No. 10-2015-0000775, filed on Jan. 5, 2015, the contents of which is incorporated by reference herein in its entirety.

BACKGROUND OF THE INVENTION

1. Field of the Invention

The present invention relates to an antenna module using a cover of a mobile terminal and a mobile terminal having the same.

2. Description of the Conventional Art

Terminals may be generally classified as mobile/portable terminals or stationary terminals according to their mobility. Mobile terminals may also be classified as handheld terminals or vehicle mounted terminals according to whether or not a user can directly carry the terminal.

Mobile terminals have become increasingly more functional. Examples of such functions include data and voice communications, capturing images and video via a camera, recording audio, playing music files via a speaker system, and displaying images and video on a display. Some mobile terminals include additional functionality which supports game playing, while other terminals are configured as multimedia players. More recently, mobile terminals have been configured to receive broadcast and multicast signals which permit viewing of content such as videos and television programs.

Various attempts have been made to implement complicated functions in such a multimedia device by means of hardware or software.

Recently, there has been a great interest in an antenna module using a cover of the mobile terminal. However, since a slit or a slot is formed on the cover formulating an external appearance of the mobile terminal, an external design of the mobile terminal is deteriorated, thus requiring an improvement thereof.

SUMMARY OF THE INVENTION

It is an object of the present invention to solve the above and other problems of the conventional art.

It is another object of the present invention to provide an antenna module using a cover of a mobile terminal and a mobile terminal having the same.

It is still another object of the present invention to implement a resonance frequency of a multi-bandwidth.

To achieve these and other advantages and objects of the present invention, there is provided an antenna module including a ground plate; a metal plate spaced apart from the ground plate by a distance such that a surface of the ground plate faces a surface of the metal plate; and at least one feeding part and at least one ground part that couple the ground plate to the metal plate, wherein the at least one ground part may include a first ground part and a second ground part that are formed at two different positions along an edge of the ground plate, and wherein the first ground part and the second ground part may be spaced apart from the at least one feeding part.

In one embodiment, the at least one feeding part may include a first feeding part positioned on an upper portion of the ground plate and a second feeding part positioned on a lower portion of the ground plate, and at least one of the first feeding part or the second feeding part may be formed at an edge portion of the ground plate.

In one embodiment, the ground plate and the metal plate may be separated into a first portion and a second portion, respectively, by a cutoff member such that the first portion includes the first feeding part and the first ground part, and the second portion may include the second feeding part and the second ground part.

In one embodiment, the antenna module further include a conductive member spaced apart from the ground plate; a third feeding part formed on the ground plate to feed the conductive member; and a third ground part formed on the ground plate to ground the conductive member to the ground plate.

In one embodiment, the first feeding part and the second feeding part may directly or indirectly feed the metal plate by a conductive line or a patch.

In one embodiment, the cutoff member may include a plurality of contact terminals coupling the ground plate to the metal plate.

In one embodiment, each of the third feeding part and the third ground part may include a corresponding matching module.

In one embodiment, the antenna module further includes a first conductive member spaced apart from the ground plate; a second conductive member positioned between the first conductive member and the ground plate to indirectly feed the first conductive member; a third feeding part formed on the ground plate to feed the second conductive member; and a third ground part formed on the ground plate to ground the second conductive member to the ground plate.

In one embodiment, each of the third feeding part and the third ground part may include a corresponding matching module.

In one embodiment, at least part of the first and second ground parts and the plurality of contact terminals may have an electrical length that is variable at the metal plate and the ground plate by a variable device including a lumped element and a switch coupled to the variable device.

In one embodiment, an antenna module including a ground plate; a first conductive member formed at one side of the ground plate; a metal plate spaced apart from the ground plate and the first conductive member by a distance such that a surface of the metal plate faces a surface of the ground plate and a surface of the first conductive member; a feeding part formed on the ground plate to feed the first conductive member; and a ground part to ground the metal plate to the ground plate, wherein the first conductive member and the metal plate may be electrically connected via at least one point; an area of the ground plate may be smaller than an area of the metal plate; and a first slot may be formed between the ground plate and the first conducive member, and a second slot may be formed between the ground plate and the metal plate.

In one embodiment, the metal plate may be shaped to enclose the ground plate and the first conductive member.

In one embodiment, the ground part may have an electrical length that is variable by a variable device including a lumped element and a switch coupled to the variable device.

In one embodiment, the first conductive member and the ground plate may be coupled to each other via a connection part protruded from the first conductive member or the ground plate.

In one embodiment, the first conductive member and the ground plate may be selectively coupled to each other by first and second switches that are spaced apart from each other.

In one embodiment, the antenna module further includes a second conductive member formed between the first conductive member and the ground plate, wherein the feeding part may be directly feeds the second conductive member; and the second conductive member may indirectly feed the first conductive member.

In one embodiment, the connection part may include a protrusion part formed between the first conductive member and the ground plate; the protrusion part may be electrically connected to the metal plate via one point; and the feeding part may include a switch for selectively connecting the feeding part to the protrusion part or the first conductive member.

In one embodiment, a mobile terminal including a terminal body; and an antenna module provided within the terminal body and comprising: a ground plate; a metal plate that is spaced apart from the ground plate by a distance such that a surface of the ground plate faces a surface of the metal plate; and a feeding part and a ground part that couple the ground plate to the metal plate, wherein the ground plate may include a first ground part and a second ground part that are formed at two different positions along an edge of the ground plate, and wherein the first ground part and the second ground part may be differently distanced from the feeding part.

In one embodiment, the metal plate may be a cover shaped to cover the terminal body, and the ground plate may be a printed circuit board.

In one embodiment, the mobile terminal may further include a conductive member spaced apart from the ground plate, wherein the feeding part may be formed on the ground plate to feed the conductive member; the ground part may be formed on the ground plate to ground the conductive member to the ground plate; and the conductive member may be formed at an inner side of a side surface of the terminal body.

In one embodiment, a mobile terminal including a terminal body; and an antenna module provided within the terminal body and comprising: a ground plate; a first conductive member formed on one side of the ground plate and electrically connected to the ground plate; a metal plate spaced apart from the ground plate and the first conductive member by a distance such that a surface of the metal plate faces a surface of the ground plate and a surface of the conductive member; a feeding part formed on the ground plate to feed the first conductive member; and a ground part to ground the metal plate to the ground plate, wherein the first conductive member and the metal plate may be electrically connected via at least one point; and a first slot may be formed between the ground plate and the first conductive member, and a second slot may be formed between the ground plate and the metal plate.

In one embodiment, the first conductive member and the ground plate may be coupled to each other via a connection part protruded from the first conductive member or the ground plate.

In one embodiment, the connection part includes a protrusion part formed between the first conductive member and the ground plate; the protrusion part may be electrically connected to the metal plate via one point; and the feeding part may include a switch for selectively connecting the feeding part to the protrusion part or the first conductive member.

In one embodiment, the first conductive member and the ground plate may be selectively coupled to each other by first and second switches that are spaced apart from each other.

In one embodiment, the antenna module may further include a second conductive member that is formed between the first conductive member and the ground plate; the feeding part may directly feed the second conductive member; and the second conductive member may indirectly feed the first conductive member.

According to an embodiment of the present invention, there are provided the following effects and advantages.

That is, according to at least one embodiment of the present invention, it is possible to fabricate an antenna module without forming slots on a cover of a mobile terminal.

Further, according to at least one embodiment of the present invention, it is possible to prevent an external design of a mobile terminal from deteriorating by forming no slots on a cover that forms an external appearance of the mobile terminal.

BRIEF DESCRIPTION OF THE DRAWING

The present invention will become more fully understood from the detailed description given hereinbelow and accompanying drawings, which are given by illustration only, and thus are not limitative of the present invention, and wherein.

DETAILED DESCRIPTION OF THE PREFERRED EMBODIMENTS

Figure 1A:
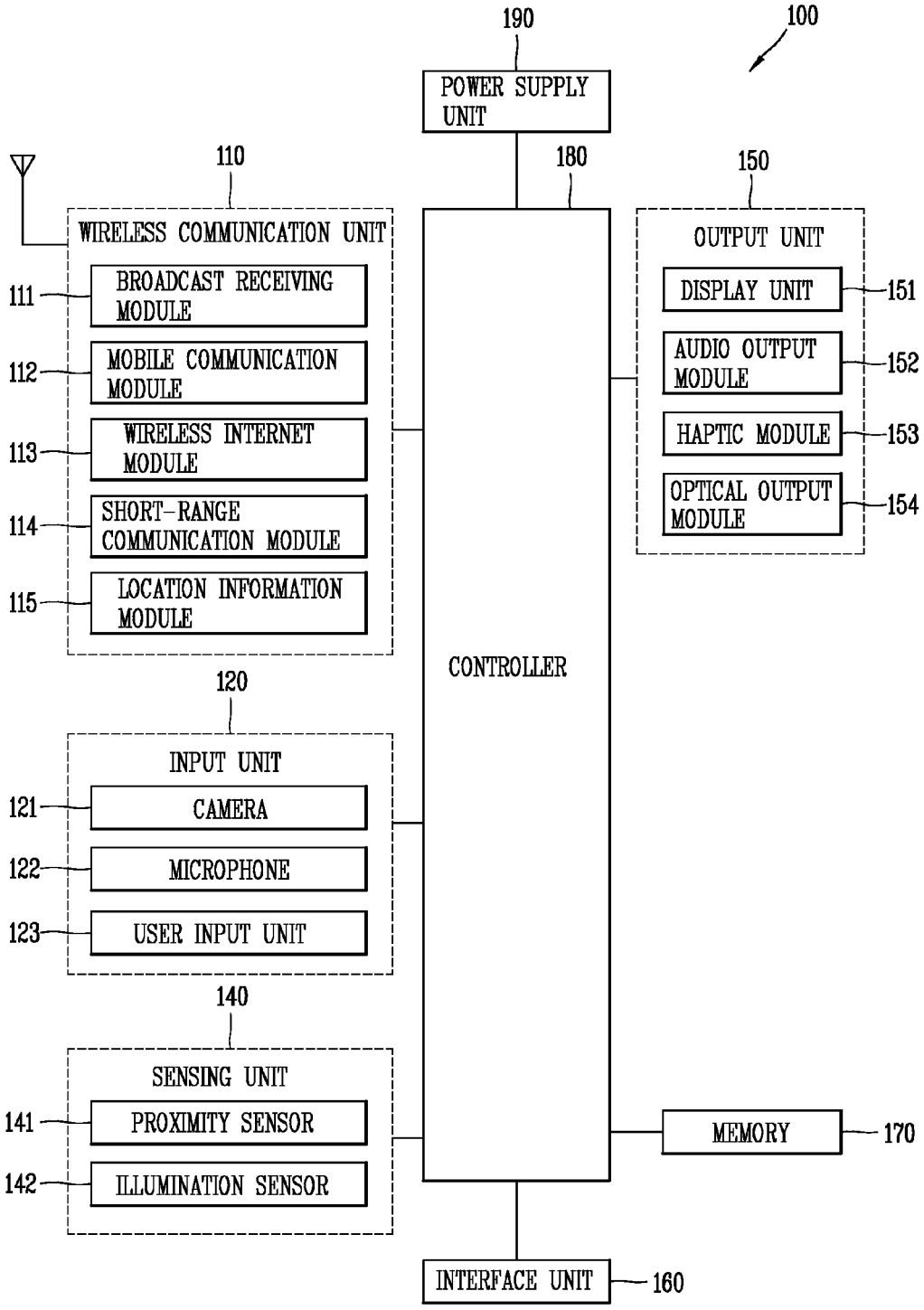
FIG. 1A is a block diagram illustrating a schematic configuration of a mobile terminal according to an embodiment of the present invention.

Description will now be given in detail according to exemplary embodiments disclosed herein, with reference to the accompanying drawings. For the sake of brief description with reference to the drawings, the same or equivalent components may be provided with the same or similar reference numbers, and description thereof will not be repeated. In general, a suffix such as "module" and "unit" may be used to refer to elements or components. Use of such a suffix herein is merely intended to facilitate description of the specification, and the suffix itself is not intended to give any special meaning or function. In the present disclosure, that which is well-known to one of ordinary skill in the relevant art has generally been omitted for the sake of brevity. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

It will be understood that although the terms first, second, etc. may be used herein to describe various elements, these elements should not be limited by these terms. These terms are generally only used to distinguish one element from another.

It will be understood that when an element is referred to as being "connected with" another element, the element can be connected with the other element or intervening elements may also be present. In contrast, when an element is referred to as being "directly connected with" another element, there are no intervening elements present.

A singular representation may include a plural representation unless it represents a definitely different meaning from the context. Terms such as "include" or "has" are used herein and should be understood that they are intended to indicate an existence of several components, functions or steps, disclosed in the specification, and it is also understood that greater or fewer components, functions, or steps may likewise be utilized.

Mobile terminals presented herein may be implemented using a variety of different types of terminals. Examples of such terminals include cellular phones, smart phones, user equipment, laptop computers, digital broadcast terminals, personal digital assistants (PDAs), portable multimedia players (PMPs), navigators, portable computers (PCs), slate PCs, tablet PCs, ultra books, wearable devices (for example, smart watches, smart glasses, head mounted displays (HMDs)), and the like.

By way of non-limiting example only, further description will be made with reference to particular types of mobile terminals. However, such teachings apply equally to other types of terminals, such as those types noted above. In addition, these teachings may also be applied to stationary terminals such as digital TV, desktop computers, and the like.

Figure 1B:
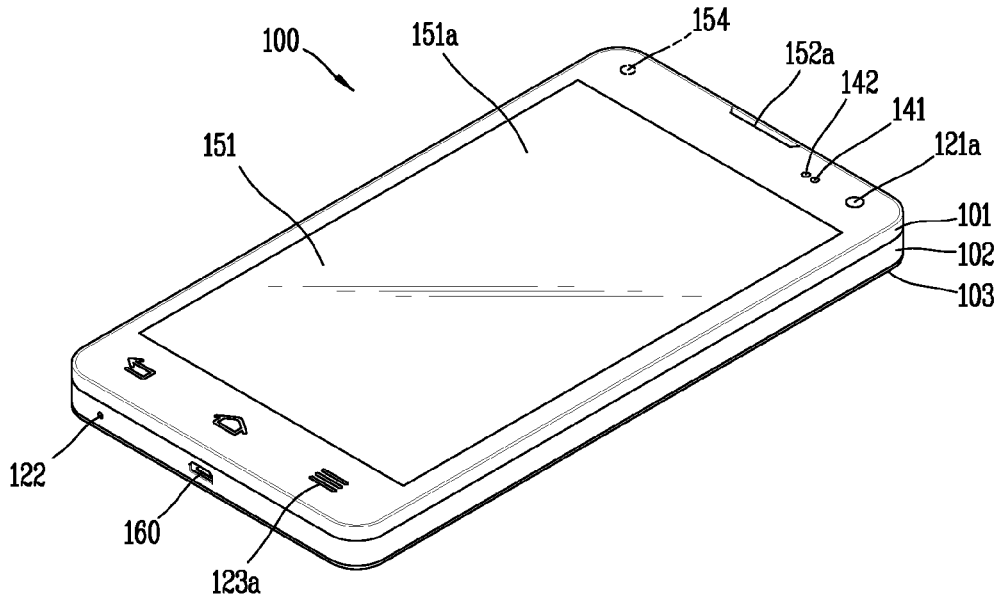
FIGS. 1B and 1C are schematic views illustrating a mobile terminal according to an embodiment of the present invention, which are viewed from different directions.
Figure 1C:
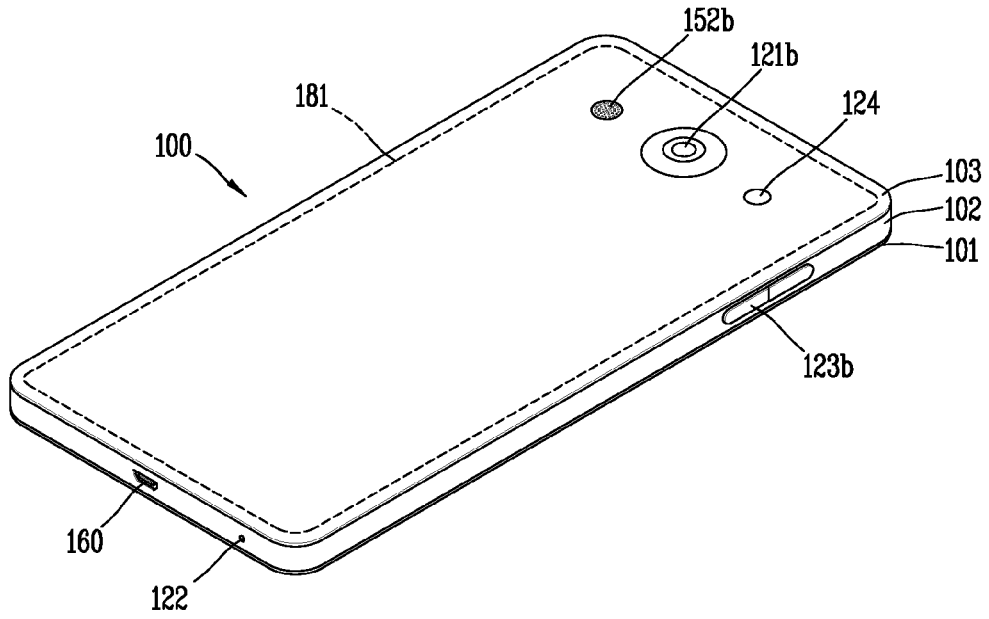

Reference is now made to FIGS. 1A-1C, where FIG. 1A is a block diagram of a mobile terminal in accordance with the present disclosure, and FIGS. 1B and 1C are conceptual views of one example of the mobile terminal, viewed from different directions.

The mobile terminal 100 is shown having components such as a wireless communication unit 110, an input unit 120, a sensing unit 140, an output unit 150, an interface unit 160, a memory 170, a controller 180, and a power supply unit 190. It is understood that implementing all of the illustrated components is not a requirement, and that greater or fewer components may alternatively be implemented.

Referring now to FIG. 1A, the mobile terminal 100 is shown having wireless communication unit 110 configured with several commonly implemented components. For instance, the wireless communication unit 110 typically includes one or more components which permit wireless communication between the mobile terminal 100 and a wireless communication system or network within which the mobile terminal is located.

The wireless communication unit 110 typically includes one or more modules which permit communications such as wireless communications between the mobile terminal 100 and a wireless communication system, communications between the mobile terminal 100 and another mobile terminal, communications between the mobile terminal 100 and an external server. Further, the wireless communication unit 110 typically includes one or more modules which connect the mobile terminal 100 to one or more networks.

To facilitate such communications, the wireless communication unit 110 includes one or more of a broadcast receiving module 111, a mobile communication module 112, a wireless Internet module 113, a short-range communication module 114, and a location information module 115.

The input unit 120 includes a camera 121 for obtaining images or video, a microphone 122, which is one type of audio input device for inputting an audio signal, and a user input unit 123 (for example, a touch key, a push key, a mechanical key, a soft key, and the like) for allowing a user to input information. Data (for example, audio, video, image, and the like) is obtained by the input unit 120 and may be analyzed and processed by controller 180 according to device parameters, user commands, and combinations thereof.

The sensing unit 140 is typically implemented using one or more sensors configured to sense internal information of the mobile terminal, the surrounding environment of the mobile terminal, user information, and the like. For example, in FIG. 1A, the sensing unit 140 is shown having a proximity sensor 141 and an illumination sensor 142.

If desired, the sensing unit 140 may alternatively or additionally include other types of sensors or devices, such as a touch sensor, an acceleration sensor, a magnetic sensor, a G-sensor, a gyroscope sensor, a motion sensor, an RGB sensor, an infrared (IR) sensor, a finger scan sensor, a ultrasonic sensor, an optical sensor (for example, camera 121), a microphone 122, a battery gauge, an environment sensor (for example, a barometer, a hygrometer, a thermometer, a radiation detection sensor, a thermal sensor, and a gas sensor, among others), and a chemical sensor (for example, an electronic nose, a health care sensor, a biometric sensor, and the like), to name a few. The mobile terminal 100 may be configured to utilize information obtained from sensing unit 140, and in particular, information obtained from one or more sensors of the sensing unit 140, and combinations thereof.

The output unit 150 is typically configured to output various types of information, such as audio, video, tactile output, and the like. The output unit 150 is shown having a display unit 151, an audio output module 152, a haptic module 153, and an optical output module 154.

The display unit 151 may have an inter-layered structure or an integrated structure with a touch sensor in order to facilitate a touch screen. The touch screen may provide an output interface between the mobile terminal 100 and a user, as well as function as the user input unit 123 which provides an input interface between the mobile terminal 100 and the user.

The interface unit 160 serves as an interface with various types of external devices that can be coupled to the mobile terminal 100. The interface unit 160, for example, may include any of wired or wireless ports, external power supply ports, wired or wireless data ports, memory card ports, ports for connecting a device having an identification module, audio input/output (I/O) ports, video I/O ports, earphone ports, and the like. In some cases, the mobile terminal 100 may perform assorted control functions associated with a connected external device, in response to the external device being connected to the interface unit 160.

The memory 170 is typically implemented to store data to support various functions or features of the mobile terminal 100. For instance, the memory 170 may be configured to store application programs executed in the mobile terminal 100, data or instructions for operations of the mobile terminal 100, and the like. Some of these application programs may be downloaded from an external server via wireless communication. Other application programs may be installed within the mobile terminal 100 at time of manufacturing or shipping, which is typically the case for basic functions of the mobile terminal 100 (for example, receiving a call, placing a call, receiving a message, sending a message, and the like). It is common for application programs to be stored in the memory 170, installed in the mobile terminal 100, and executed by the controller 180 to perform an operation (or function) for the mobile terminal 100.

The controller 180 typically functions to control overall operation of the mobile terminal 100, in addition to the operations associated with the application programs. The controller 180 may provide or process information or functions appropriate for a user by processing signals, data, information and the like, which are input or output by the various components depicted in FIG. 1A, or activating application programs stored in the memory 170. As one example, the controller 180 controls some or all of the components illustrated in FIGS. 1A-1C according to the execution of an application program that have been stored in the memory 170.

The power supply unit 190 can be configured to receive external power or provide internal power in order to supply appropriate power required for operating elements and components included in the mobile terminal 100. The power supply unit 190 may include a battery, and the battery may be configured to be embedded in the terminal body, or configured to be detachable from the terminal body.

At least some of the above components may operate in a cooperating manner, so as to implement an operation or a control method for a glass type terminal according to various embodiments to be explained later. The operation or the control method for the glass type terminal may be implemented on the glass type terminal by driving at least one application program stored in the memory 170.

Referring still to FIG. 1A, various components depicted in this figure will now be described in more detail. Regarding the wireless communication unit 110, the broadcast receiving module 111 is typically configured to receive a broadcast signal and/or broadcast associated information from an external broadcast managing entity via a broadcast channel. The broadcast channel may include a satellite channel, a terrestrial channel, or both. In some embodiments, two or more broadcast receiving modules 111 may be utilized to facilitate simultaneously receiving of two or more broadcast channels, or to support switching among broadcast channels.

The mobile communication module 112 can transmit and/or receive wireless signals to and from one or more network entities. Typical examples of a network entity include a base station, an external mobile terminal, a server, and the like. Such network entities form part of a mobile communication network, which is constructed according to technical standards or communication methods for mobile communications (for example, Global System for Mobile Communication (GSM), Code Division Multi Access (CDMA), CDMA2000 (Code Division Multi Access 2000), EV-DO (Enhanced Voice-Data Optimized or Enhanced Voice-Data Only), Wideband CDMA (WCDMA), High Speed Downlink Packet access (HSDPA), HSUPA (High Speed Uplink Packet Access), Long Term Evolution (LTE), LTE-A (Long Term Evolution-Advanced), and the like). Examples of wireless signals transmitted and/or received via the mobile communication module 112 include audio call signals, video (telephony) call signals, or various formats of data to support communication of text and multimedia messages.

The wireless Internet module 113 is configured to facilitate wireless Internet access. This module may be internally or externally coupled to the mobile terminal 100. The wireless Internet module 113 may transmit and/or receive wireless signals via communication networks according to wireless Internet technologies.

Examples of such wireless Internet access include Wireless LAN (WLAN), Wireless Fidelity (Wi-Fi), Wi-Fi Direct, Digital Living Network Alliance (DLNA), Wireless Broadband (WiBro), Worldwide Interoperability for Microwave Access (WiMAX), High Speed Downlink Packet Access (HSDPA), HSUPA (High Speed Uplink Packet Access), Long Term Evolution (LTE), LTE-A (Long Term Evolution-Advanced), and the like. The wireless Internet module 113 may transmit/receive data according to one or more of such wireless Internet technologies, and other Internet technologies as well.

In some embodiments, when the wireless Internet access is implemented according to, for example, WiBro, HSDPA, HSUPA, GSM, CDMA, WCDMA, LTE, LTE-A and the like, as part of a mobile communication network, the wireless Internet module 113 performs such wireless Internet access. As such, the Internet module 113 may cooperate with, or function as, the mobile communication module 112.

The short-range communication module 114 is configured to facilitate short-range communications. Suitable technologies for implementing such short-range communications include BLUETOOTH™, Radio Frequency IDentification (RFID), Infrared Data Association (IrDA), Ultra-WideBand (UWB), ZigBee, Near Field Communication (NFC), Wireless-Fidelity (Wi-Fi), Wi-Fi Direct, Wireless USB (Wireless Universal Serial Bus), and the like. The short-range communication module 114 in general supports wireless communications between the mobile terminal 100 and a wireless communication system, communications between the mobile terminal 100 and another mobile terminal 100, or communications between the mobile terminal and a network where another mobile terminal 100 (or an external server) is located, via wireless area networks. One example of the wireless area networks is a wireless personal area networks.

In some embodiments, another mobile terminal (which may be configured similarly to mobile terminal 100) may be a wearable device, for example, a smart watch, a smart glass or a head mounted display (HMD), which is able to exchange data with the mobile terminal 100 (or otherwise cooperate with the mobile terminal 100). The short-range communication module 114 may sense or recognize the wearable device, and permit communication between the wearable device and the mobile terminal 100. In addition, when the sensed wearable device is a device which is authenticated to communicate with the mobile terminal 100, the controller 180, for example, may cause transmission of data processed in the mobile terminal 100 to the wearable device via the short-range communication module 114. Hence, a user of the wearable device may use the data processed in the mobile terminal 100 on the wearable device. For example, when a call is received in the mobile terminal 100, the user may answer the call using the wearable device. Also, when a message is received in the mobile terminal 100, the user can check the received message using the wearable device.

The location information module 115 is generally configured to detect, calculate, derive or otherwise identify a position of the mobile terminal. As an example, the location information module 115 includes a Global Position System (GPS) module, a Wi-Fi module, or both. If desired, the location information module 115 may alternatively or additionally function with any of the other modules of the wireless communication unit 110 to obtain data related to the position of the mobile terminal.

As one example, when the mobile terminal uses a GPS module, a position of the mobile terminal may be acquired using a signal sent from a GPS satellite. As another example, when the mobile terminal uses the Wi-Fi module, a position of the mobile terminal can be acquired based on information related to a wireless access point (AP) which transmits or receives a wireless signal to or from the Wi-Fi module.

The input unit 120 may be configured to permit various types of input to the mobile terminal 120. Examples of such input include audio, image, video, data, and user input. Image and video input is often obtained using one or more cameras 121. Such cameras 121 may process image frames of still pictures or video obtained by image sensors in a video or image capture mode. The processed image frames can be displayed on the display unit 151 or stored in memory 170. In some cases, the cameras 121 may be arranged in a matrix configuration to permit a plurality of images having various angles or focal points to be input to the mobile terminal 100. As another example, the cameras 121 may be located in a stereoscopic arrangement to acquire left and right images for implementing a stereoscopic image.

The microphone 122 is generally implemented to permit audio input to the mobile terminal 100. The audio input can be processed in various manners according to a function being executed in the mobile terminal 100. If desired, the microphone 122 may include assorted noise removing algorithms to remove unwanted noise generated in the course of receiving the external audio.

The user input unit 123 is a component that permits input by a user. Such user input may enable the controller 180 to control operation of the mobile terminal 100. The user input unit 123 may include one or more of a mechanical input element (for example, a key, a button located on a front and/or rear surface or a side surface of the mobile terminal 100, a dome switch, a jog wheel, a jog switch, and the like), or a touch-sensitive input, among others. As one example, the touch-sensitive input may be a virtual key or a soft key, which is displayed on a touch screen through software processing, or a touch key which is located on the mobile terminal at a location that is other than the touch screen. On the other hand, the virtual key or the visual key may be displayed on the touch screen in various shapes, for example, graphic, text, icon, video, or a combination thereof.

The sensing unit 140 is generally configured to sense one or more of internal information of the mobile terminal, surrounding environment information of the mobile terminal, user information, or the like. The controller 180 generally cooperates with the sending unit 140 to control operation of the mobile terminal 100 or execute data processing, a function or an operation associated with an application program installed in the mobile terminal based on the sensing provided by the sensing unit 140. The sensing unit 140 may be implemented using any of a variety of sensors, some of which will now be described in more detail.

The proximity sensor 141 may include a sensor to sense presence or absence of an object approaching a surface, or an object located near a surface, by using an electromagnetic field, infrared rays, or the like without a mechanical contact. The proximity sensor 141 may be arranged at an inner region of the mobile terminal covered by the touch screen, or near the touch screen.

The proximity sensor 141, for example, may include any of a transmissive type photoelectric sensor, a direct reflective type photoelectric sensor, a mirror reflective type photoelectric sensor, a high-frequency oscillation proximity sensor, a capacitance type proximity sensor, a magnetic type proximity sensor, an infrared rays proximity sensor, and the like. When the touch screen is implemented as a capacitance type, the proximity sensor 141 can sense proximity of a pointer relative to the touch screen by changes of an electromagnetic field, which is responsive to an approach of an object with conductivity. In this case, the touch screen (touch sensor) may also be categorized as a proximity sensor.

The term "proximity touch" will often be referred to herein to denote the scenario in which a pointer is positioned to be proximate to the touch screen without contacting the touch screen. The term "contact touch" will often be referred to herein to denote the scenario in which a pointer makes physical contact with the touch screen. For the position corresponding to the proximity touch of the pointer relative to the touch screen, such position will correspond to a position where the pointer is perpendicular to the touch screen. The proximity sensor 141 may sense proximity touch, and proximity touch patterns (for example, distance, direction, speed, time, position, moving status, and the like).

In general, controller 180 processes data corresponding to proximity touches and proximity touch patterns sensed by the proximity sensor 141, and cause output of visual information on the touch screen. In addition, the controller 180 can control the mobile terminal 100 to execute different operations or process different data according to whether a touch with respect to a point on the touch screen is either a proximity touch or a contact touch.

A touch sensor can sense a touch applied to the touch screen, such as display unit 151, using any of a variety of touch methods. Examples of such touch methods include a resistive type, a capacitive type, an infrared type, and a magnetic field type, among others.

As one example, the touch sensor may be configured to convert changes of pressure applied to a specific part of the display unit 151, or convert capacitance occurring at a specific part of the display unit 151, into electric input signals. The touch sensor may also be configured to sense not only a touched position and a touched area, but also touch pressure and/or touch capacitance. A touch object is generally used to apply a touch input to the touch sensor. Examples of typical touch objects include a finger, a touch pen, a stylus pen, a pointer, or the like.

When a touch input is sensed by a touch sensor, corresponding signals may be transmitted to a touch controller. The touch controller may process the received signals, and then transmit corresponding data to the controller 180. Accordingly, the controller 180 may sense which region of the display unit 151 has been touched. Here, the touch controller may be a component separate from the controller 180, the controller 180, and combinations thereof.

In some embodiments, the controller 180 may execute the same or different controls according to a type of touch object that touches the touch screen or a touch key provided in addition to the touch screen. Whether to execute the same or different control according to the object which provides a touch input may be decided based on a current operating state of the mobile terminal 100 or a currently executed application program, for example.

The touch sensor and the proximity sensor may be implemented individually, or in combination, to sense various types of touches. Such touches includes a short (or tap) touch, a long touch, a multi-touch, a drag touch, a flick touch, a pinch-in touch, a pinch-out touch, a swipe touch, a hovering touch, and the like.

If desired, an ultrasonic sensor may be implemented to recognize position information relating to a touch object using ultrasonic waves. The controller 180, for example, may calculate a position of a wave generation source based on information sensed by an illumination sensor and a plurality of ultrasonic sensors. Since light is much faster than ultrasonic waves, the time for which the light reaches the optical sensor is much shorter than the time for which the ultrasonic wave reaches the ultrasonic sensor. The position of the wave generation source may be calculated using this fact. For instance, the position of the wave generation source may be calculated using the time difference from the time that the ultrasonic wave reaches the sensor based on the light as a reference signal.

The camera 121 typically includes at least one a camera sensor (CCD, CMOS etc.), a photo sensor (or image sensors), and a laser sensor.

Implementing the camera 121 with a laser sensor may allow detection of a touch of a physical object with respect to a 3D stereoscopic image. The photo sensor may be laminated on, or overlapped with, the display device. The photo sensor may be configured to scan movement of the physical object in proximity to the touch screen. In more detail, the photo sensor may include photo diodes and transistors at rows and columns to scan content received at the photo sensor using an electrical signal which changes according to the quantity of applied light. Namely, the photo sensor may calculate the coordinates of the physical object according to variation of light to thus obtain position information of the physical object.

The display unit 151 is generally configured to output information processed in the mobile terminal 100. For example, the display unit 151 may display execution screen information of an application program executing at the mobile terminal 100 or user interface (UI) and graphic user interface (GUI) information in response to the execution screen information.

In some embodiments, the display unit 151 may be implemented as a stereoscopic display unit for displaying stereoscopic images. A typical stereoscopic display unit may employ a stereoscopic display scheme such as a stereoscopic scheme (a glass scheme), an auto-stereoscopic scheme (glassless scheme), a projection scheme (holographic scheme), or the like.

The audio output module 152 is generally configured to output audio data. Such audio data may be obtained from any of a number of different sources, such that the audio data may be received from the wireless communication unit 110 or may have been stored in the memory 170. The audio data may be output during modes such as a signal reception mode, a call mode, a record mode, a voice recognition mode, a broadcast reception mode, and the like. The audio output module 152 can provide audible output related to a particular function (e.g., a call signal reception sound, a message reception sound, etc.) performed by the mobile terminal 100. The audio output module 152 may also be implemented as a receiver, a speaker, a buzzer, or the like.

A haptic module 153 can be configured to generate various tactile effects that a user feels, perceive, or otherwise experience. A typical example of a tactile effect generated by the haptic module 153 is vibration. The strength, pattern and the like of the vibration generated by the haptic module 153 can be controlled by user selection or setting by the controller. For example, the haptic module 153 may output different vibrations in a combining manner or a sequential manner.

Besides vibration, the haptic module 153 can generate various other tactile effects, including an effect by stimulation such as a pin arrangement vertically moving to contact skin, a spray force or suction force of air through a jet orifice or a suction opening, a touch to the skin, a contact of an electrode, electrostatic force, an effect by reproducing the sense of cold and warmth using an element that can absorb or generate heat, and the like.

The haptic module 153 can also be implemented to allow the user to feel a tactile effect through a muscle sensation such as the user's fingers or arm, as well as transferring the tactile effect through direct contact. Two or more haptic modules 153 may be provided according to the particular configuration of the mobile terminal 100.

An optical output module 154 can output a signal for indicating an event generation using light of a light source. Examples of events generated in the mobile terminal 100 may include message reception, call signal reception, a missed call, an alarm, a schedule notice, an email reception, information reception through an application, and the like.

A signal output by the optical output module 154 may be implemented in such a manner that the mobile terminal emits monochromatic light or light with a plurality of colors. The signal output may be terminated as the mobile terminal senses that a user has checked the generated event, for example.

The interface unit 160 serves as an interface for external devices to be connected with the mobile terminal 100. For example, the interface unit 160 can receive data transmitted from an external device, receive power to transfer to elements and components within the mobile terminal 100, or transmit internal data of the mobile terminal 100 to such external device. The interface unit 160 may include wired or wireless headset ports, external power supply ports, wired or wireless data ports, memory card ports, ports for connecting a device having an identification module, audio input/output (I/O) ports, video I/O ports, earphone ports, or the like.

The identification module may be a chip that stores various information for authenticating authority of using the mobile terminal 100 and may include a user identity module (UIM), a subscriber identity module (SIM), a universal subscriber identity module (USIM), and the like. In addition, the device having the identification module (also referred to herein as an "identifying device") may take the form of a smart card. Accordingly, the identifying device can be connected with the terminal 100 via the interface unit 160.

When the mobile terminal 100 is connected with an external cradle, the interface unit 160 can serve as a passage to allow power from the cradle to be supplied to the mobile terminal 100 or may serve as a passage to allow various command signals input by the user from the cradle to be transferred to the mobile terminal there through. Various command signals or power input from the cradle may operate as signals for recognizing that the mobile terminal is properly mounted on the cradle.

The memory 170 can store programs to support operations of the controller 180 and store input/output data (for example, phonebook, messages, still images, videos, etc.). The memory 170 may store data related to various patterns of vibrations and audio which are output in response to touch inputs on the touch screen.

The memory 170 may include one or more types of storage mediums including a Flash memory, a hard disk, a solid state disk, a silicon disk, a multimedia card micro type, a card-type memory (e.g., SD or DX memory, etc), a Random Access Memory (RAM), a Static Random Access Memory (SRAM), a Read-Only Memory (ROM), an Electrically Erasable Programmable Read-Only Memory (EEPROM), a Programmable Read-Only memory (PROM), a magnetic memory, a magnetic disk, an optical disk, and the like. The mobile terminal 100 may also be operated in relation to a network storage device that performs the storage function of the memory 170 over a network, such as the Internet.

The controller 180 may typically control the general operations of the mobile terminal 100. For example, the controller 180 may set or release a lock state for restricting a user from inputting a control command with respect to applications when a status of the mobile terminal meets a preset condition.

The controller 180 can also perform the controlling and processing associated with voice calls, data communications, video calls, and the like, or perform pattern recognition processing to recognize a handwriting input or a picture drawing input performed on the touch screen as characters or images, respectively. In addition, the controller 180 can control one or a combination of those components in order to implement various exemplary embodiments disclosed herein.

The power supply unit 190 receives external power or provide internal power and supply the appropriate power required for operating respective elements and components included in the mobile terminal 100. The power supply unit 190 may include a battery, which is typically rechargeable or be detachably coupled to the terminal body for charging.

The power supply unit 190 may include a connection port. The connection port may be configured as one example of the interface unit 160 to which an external charger for supplying power to recharge the battery is electrically connected.

As another example, the power supply unit 190 may be configured to recharge the battery in a wireless manner without use of the connection port. In this example, the power supply unit 190 can receive power, transferred from an external wireless power transmitter, using at least one of an inductive coupling method which is based on magnetic induction or a magnetic resonance coupling method which is based on electromagnetic resonance.

Various embodiments described herein may be implemented in a computer-readable medium, a machine-readable medium, or similar medium using, for example, software, hardware, or any combination thereof.

Referring now to FIGS. 1B and 1C, the mobile terminal 100 is described with reference to a bar-type terminal body. However, the mobile terminal 100 may alternatively be implemented in any of a variety of different configurations. Examples of such configurations include watch-type, clip-type, glasses-type, or as a folder-type, flip-type, slide-type, swing-type, and swivel-type in which two and more bodies are combined with each other in a relatively movable manner, and combinations thereof. Discussion herein will often relate to a particular type of mobile terminal (for example, bar-type, watch-type, glasses-type, and the like). However, such teachings with regard to a particular type of mobile terminal will generally apply to other types of mobile terminals as well.

The mobile terminal 100 will generally include a case (for example, frame, housing, cover, and the like) forming the appearance of the terminal. In this embodiment, the case is formed using a front case 101 and a rear case 102. Various electronic components are incorporated into a space formed between the front case 101 and the rear case 102. At least one middle case may be additionally positioned between the front case 101 and the rear case 102.

The display unit 151 is shown located on the front side of the terminal body to output information. As illustrated, a window 151*a* of the display unit 151 may be mounted to the front case 101 to form the front surface of the terminal body together with the front case 101.

In some embodiments, electronic components may also be mounted to the rear case 102. Examples of such electronic components include a detachable battery 191, an identification module, a memory card, and the like. Rear cover 103 is shown covering the electronic components, and this cover may be detachably coupled to the rear case 102. Therefore, when the rear cover 103 is detached from the rear case 102, the electronic components mounted to the rear case 102 are externally exposed.

As illustrated, when the rear cover 103 is coupled to the rear case 102, a side surface of the rear case 102 is partially exposed. In some cases, upon the coupling, the rear case 102 may also be completely shielded by the rear cover 103. In some embodiments, the rear cover 103 may include an opening for externally exposing a camera 121*b* or an audio output module 152*b*.

The cases 101, 102, 103 may be formed by injection-molding synthetic resin or may be formed of a metal, for example, stainless steel (STS), aluminum (Al), titanium (Ti), or the like.

As an alternative to the example in which the plurality of cases form an inner space for accommodating components, the mobile terminal 100 may be configured such that one case forms the inner space. In this example, a mobile terminal 100 having a uni-body is formed in such a manner that synthetic resin or metal extends from a side surface to a rear surface.

If desired, the mobile terminal 100 may include a waterproofing unit (not shown) for preventing introduction of water into the terminal body. For example, the waterproofing unit may include a waterproofing member which is located between the window 151*a* and the front case 101, between the front case 101 and the rear case 102, or between the rear case 102 and the rear cover 103, to hermetically seal an inner space when those cases are coupled.

FIGS. 1B and 1C depict certain components as arranged on the mobile terminal. However, it is to be understood that alternative arrangements are possible and within the teachings of the instant disclosure. Some components may be omitted or rearranged. For example, the first manipulation unit 123*a* may be located on another surface of the terminal body, and the second audio output module 152*b* may be located on the side surface of the terminal body.

The display unit 151 outputs information processed in the mobile terminal 100. The display unit 151 may be implemented using one or more suitable display devices. Examples of such suitable display devices include a liquid crystal display (LCD), a thin film transistor-liquid crystal display (TFT-LCD), an organic light emitting diode (OLED), a flexible display, a 3-dimensional (3D) display, an e-ink display, and combinations thereof.

The display unit 151 may be implemented using two display devices, which can implement the same or different display technology. For instance, a plurality of the display units 151 may be arranged on one side, either spaced apart from each other, or these devices may be integrated, or these devices may be arranged on different surfaces.

The display unit 151 may also include a touch sensor which senses a touch input received at the display unit. When a touch is input to the display unit 151, the touch sensor may be configured to sense this touch and the controller 180, for example, may generate a control command or other signal corresponding to the touch. The content which is input in the touching manner may be a text or numerical value, or a menu item which can be indicated or designated in various modes.

The touch sensor may be configured in a form of a film having a touch pattern, disposed between the window 151*a* and a display on a rear surface of the window 151*a*, or a metal wire which is patterned directly on the rear surface of the window 151*a*. Alternatively, the touch sensor may be integrally formed with the display. For example, the touch sensor may be disposed on a substrate of the display or within the display.

The display unit 151 may also form a touch screen together with the touch sensor. Here, the touch screen may serve as the user input unit 123 (see FIG. 1A). Therefore, the touch screen may replace at least some of the functions of the first manipulation unit 123*a*.

The first audio output module 152*a* may be implemented in the form of a speaker to output voice audio, alarm sounds, multimedia audio reproduction, and the like.

The window 151*a* of the display unit 151 will typically include an aperture to permit audio generated by the first audio output module 152*a* to pass. One alternative is to allow audio to be released along an assembly gap between the structural bodies (for example, a gap between the window 151*a* and the front case 101). In this case, a hole independently formed to output audio sounds may not be seen or is otherwise hidden in terms of appearance, thereby further simplifying the appearance and manufacturing of the mobile terminal 100.

The optical output module 154 can be configured to output light for indicating an event generation. Examples of such events include a message reception, a call signal reception, a missed call, an alarm, a schedule notice, an email reception, information reception through an application, and the like. When a user has checked a generated event, the controller can control the optical output unit 154 to stop the light output.

The first camera 121*a* can process image frames such as still or moving images obtained by the image sensor in a capture mode or a video call mode. The processed image frames can then be displayed on the display unit 151 or stored in the memory 170.

The first and second manipulation units 123*a* and 123*b* are examples of the user input unit 123, which may be manipulated by a user to provide input to the mobile terminal 100. The first and second manipulation units 123*a* and 123*b* may also be commonly referred to as a manipulating portion, and may employ any tactile method that allows the user to perform manipulation such as touch, push, scroll, or the like. The first and second manipulation units 123*a* and 123*b* may also employ any non-tactile method that allows the user to perform manipulation such as proximity touch, hovering, or the like.

FIG. 1B illustrates the first manipulation unit 123*a* as a touch key, but possible alternatives include a mechanical key, a push key, a touch key, and combinations thereof.

Input received at the first and second manipulation units 123*a* and 123*b* may be used in various ways. For example, the first manipulation unit 123*a* may be used by the user to provide an input to a menu, home key, cancel, search, or the like, and the second manipulation unit 123*b* may be used by the user to provide an input to control a volume level being output from the first or second audio output modules 152*a* or 152*b*, to switch to a touch recognition mode of the display unit 151, or the like.

As another example of the user input unit 123, a rear input unit (not shown) may be located on the rear surface of the terminal body. The rear input unit can be manipulated by a user to provide input to the mobile terminal 100. The input may be used in a variety of different ways. For example, the rear input unit may be used by the user to provide an input for power on/off, start, end, scroll, control volume level being output from the first or second audio output modules 152*a* or 152*b*, switch to a touch recognition mode of the display unit 151, and the like. The rear input unit may be configured to permit touch input, a push input, or combinations thereof.

The rear input unit may be located to overlap the display unit 151 of the front side in a thickness direction of the terminal body. As one example, the rear input unit may be located on an upper end portion of the rear side of the terminal body such that a user can easily manipulate it using a forefinger when the user grabs the terminal body with one hand. Alternatively, the rear input unit can be positioned at most any location of the rear side of the terminal body.

Embodiments that include the rear input unit may implement some or all of the functionality of the first manipulation unit 123*a* in the rear input unit. As such, in situations where the first manipulation unit 123*a* is omitted from the front side, the display unit 151 can have a larger screen.

As a further alternative, the mobile terminal 100 may include a finger scan sensor which scans a user's fingerprint. The controller 180 can then use fingerprint information sensed by the finger scan sensor as part of an authentication procedure. The finger scan sensor may also be installed in the display unit 151 or implemented in the user input unit 123.

The microphone 122 is shown located at an end of the mobile terminal 100, but other locations are possible. If desired, multiple microphones may be implemented, with such an arrangement permitting the receiving of stereo sounds.

The interface unit 160 may serve as a path allowing the mobile terminal 100 to interface with external devices. For example, the interface unit 160 may include one or more of a connection terminal for connecting to another device (for example, an earphone, an external speaker, or the like), a port for near field communication (for example, an Infrared Data Association (IrDA) port, a Bluetooth port, a wireless LAN port, and the like), or a power supply terminal for supplying power to the mobile terminal 100. The interface unit 160 may be implemented in the form of a socket for accommodating an external card, such as Subscriber Identification Module (SIM), User Identity Module (UIM), or a memory card for information storage.

The second camera 121*b* is shown located at the rear side of the terminal body and includes an image capturing direction that is substantially opposite to the image capturing direction of the first camera unit 121*a*. If desired, second camera 121*a* may alternatively be located at other locations, or made to be moveable, in order to have a different image capturing direction from that which is shown.

The second camera 121*b* can include a plurality of lenses arranged along at least one line. The plurality of lenses may also be arranged in a matrix configuration. The cameras may be referred to as an "array camera." When the second camera 121*b* is implemented as an array camera, images may be captured in various manners using the plurality of lenses and images with better qualities.

As shown in FIG. 1C, a flash 124 is shown adjacent to the second camera 121*b*. When an image of a subject is captured with the camera 121*b*, the flash 124 may illuminate the subject.

As shown in FIG. 1B, the second audio output module 152*b* can be located on the terminal body. The second audio output module 152*b* may implement stereophonic sound functions in conjunction with the first audio output module 152*a*, and may be also used for implementing a speaker phone mode for call communication.

At least one antenna for wireless communication may be located on the terminal body. The antenna may be installed in the terminal body or formed by the case. For example, an antenna which configures a part of the broadcast receiving module 111 may be retractable into the terminal body. Alternatively, an antenna may be formed using a film attached to an inner surface of the rear cover 103, or a case that includes a conductive material.

A power supply unit 190 for supplying power to the mobile terminal 100 may include a battery 191, which is mounted in the terminal body or detachably coupled to an outside of the terminal body. The battery 191 may receive power via a power source cable connected to the interface unit 160. Also, the battery 191 can be recharged in a wireless manner using a wireless charger. Wireless charging may be implemented by magnetic induction or electromagnetic resonance.

The rear cover 103 is shown coupled to the rear case 102 for shielding the battery 191, to prevent separation of the battery 191, and to protect the battery 191 from an external impact or from foreign material. When the battery 191 is detachable from the terminal body, the rear case 103 may be detachably coupled to the rear case 102.

An accessory for protecting an appearance or assisting or extending the functions of the mobile terminal 100 can also be provided on the mobile terminal 100. As one example of an accessory, a cover or pouch for covering or accommodating at least one surface of the mobile terminal 100 may be provided. The cover or pouch may cooperate with the display unit 151 to extend the function of the mobile terminal 100. Another example of the accessory is a touch pen for assisting or extending a touch input to a touch screen.

Figure 2A:
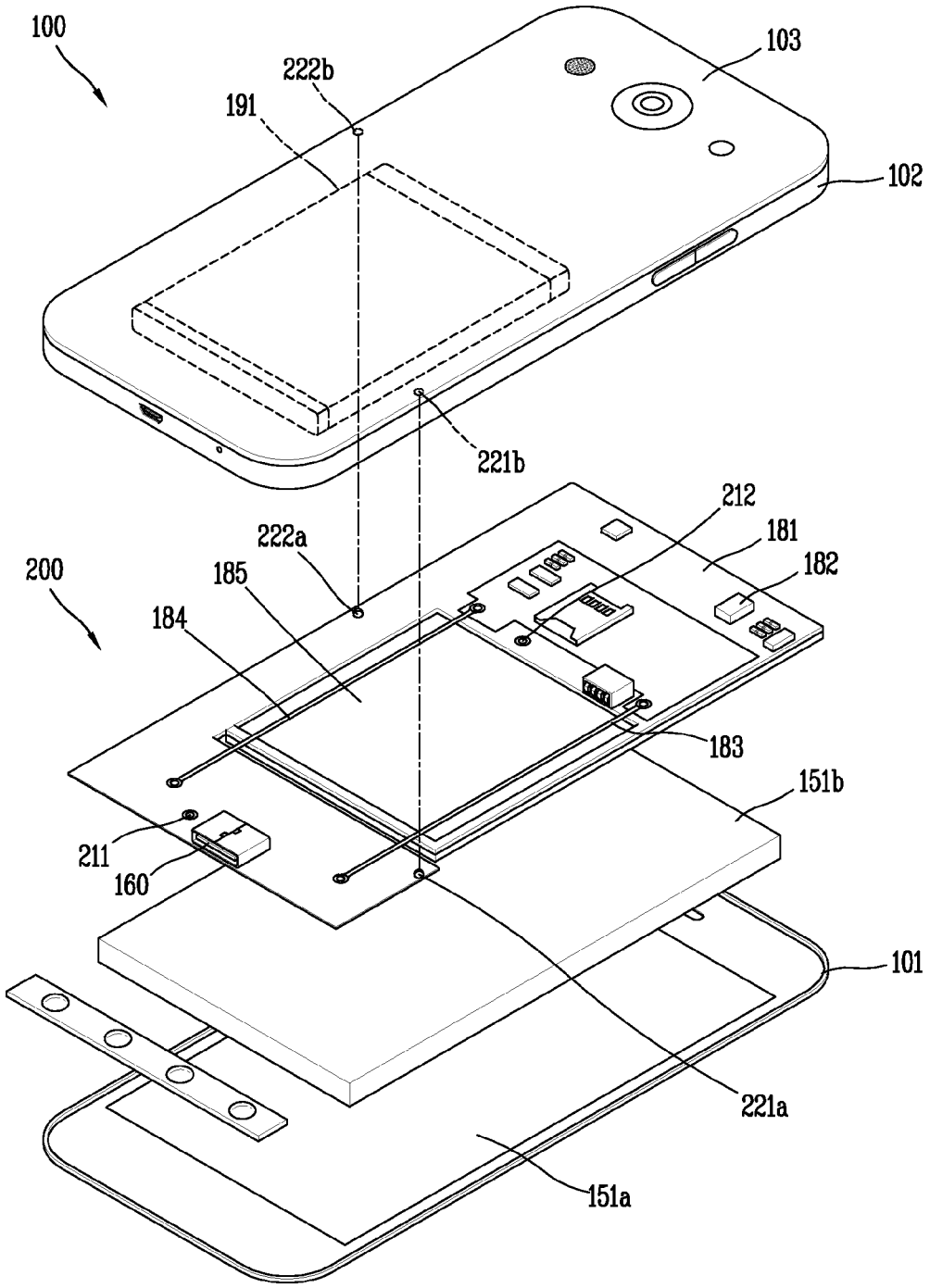
FIGS. 2A and 2B are disassembled perspective view illustrating a mobile terminal according to first and second embodiments of the present invention, respectively.
Figure 2B:
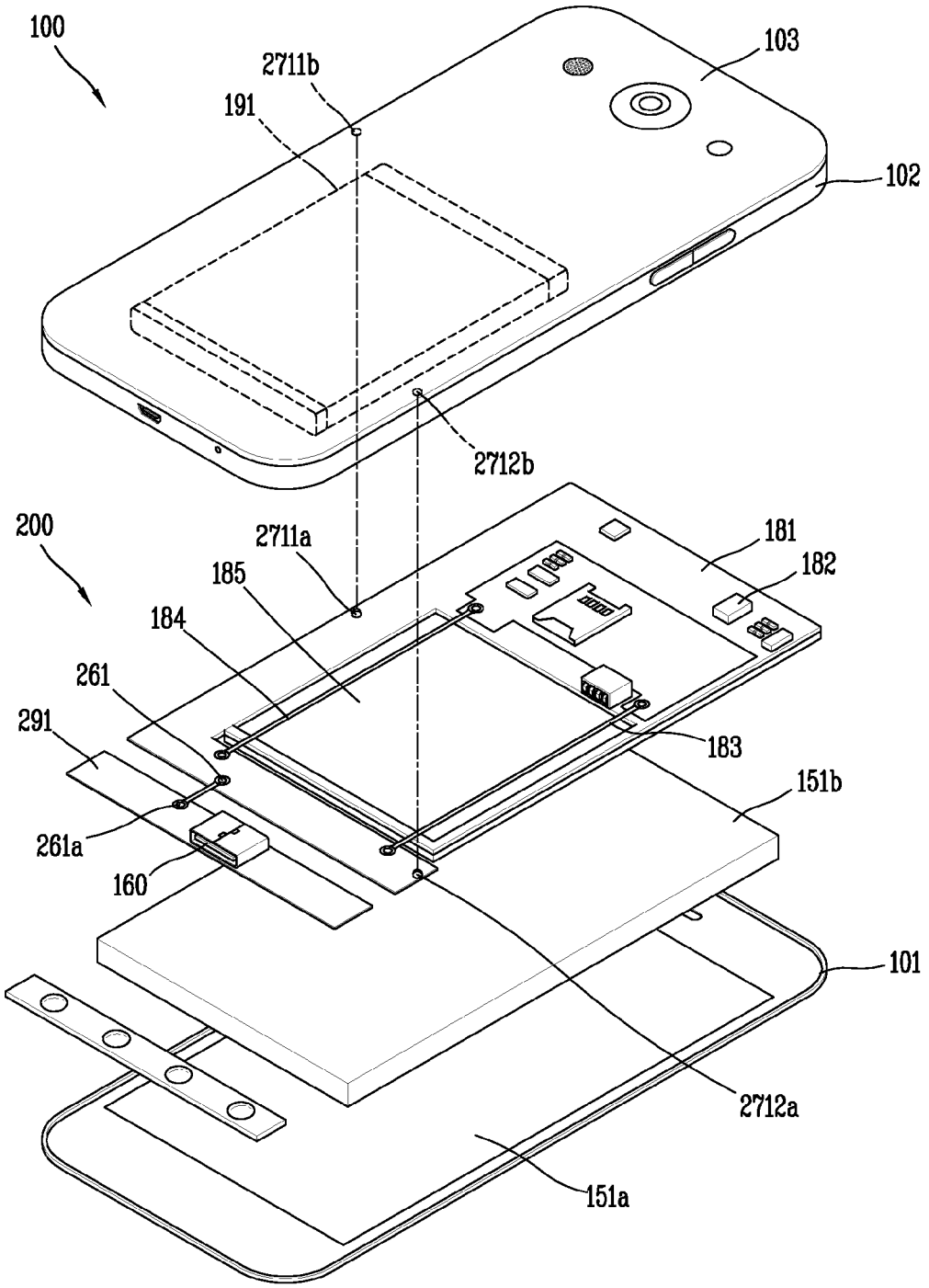

FIGS. 2A and 2B are disassembled perspective view illustrating a mobile terminal according to first and second embodiments of the present invention, respectively.

Referring to FIG. 2A, there is shown an antenna module 200 formed on a rear cover 103 between a printed circuit board 181 which is a ground plate and a terminal body, and referring to FIG. 2B, there is shown an antenna module 200 formed by a conductive member which is formed to be spaced apart from the ground plate 181. In FIG. 2B, the rear cover among the terminal body is used as part of the antenna module 200.

The mobile terminal according to first and second embodiments of the present invention includes a window 151*a* and a display module 151*b* that constitute the display unit 151. The window 151*a* may be coupled to one side of the front case 101.

A frame 185 is provided between the front case 101 and the rear case 102 to support electric components thereon. The frame 185 is a kind of support structure within the mobile terminal, and may be fabricated to support, for instance, at least one of the display module 151*b*, the camera module 121*b*, the antenna module 200, the battery 191, or the printed circuit board 181.

Part of the frame 185 may be exposed to the terminal body. Further, the frame 185 may constitute part of a sliding module that connects the body and the display unit to each other in a slide-type terminal, not in a bar-type terminal.

FIG. 2 shows an example in which the frame 185 is disposed between the rear case 102 and the printed circuit board 181, and the display module 151*b* is coupled to one side surface of the printed circuit board 181. The rear cover 103 may be coupled to the rear case 102 so as to cover the battery 191. In this instance, the frame 185 is a component to reinforce the mobile terminal.

The window 151*a* is coupled to one side surface of the front case 101. A touch sensor (not shown) may be mounted to the window 151*a*. The touch sensor may be formed to sense a touch input, and has a light transmittance. The touch sensor may be mounted on a front surface of the window 151*a*, and fabricated to convert a change such as a voltage change generated at a specific portion of the window 151*a* into an electric input signal.

The display module 151*b* is mounted on a rear surface of the window 151*a*. In this embodiment, as an example of the display module 151*b*, a thin film transistor-liquid crystal display (TFT-LCD) is shown, but the present invention is not limited thereto.

For instance, the display module 151*b* may include a liquid crystal display (LCD), an organic light-emitting diode (OLED), a flexible display, or a 3D display.

The printed circuit board 181 may be mounted to a lower portion of the display module 151*b*. And at least one electronic component may be mounted on a lower surface of the printed circuit board 181.

An accommodation portion in a recessed form may be provided on the frame 185, in which the battery 191 may be accommodated. Further, a contact terminal connected to the circuit board 181, for supplying a power to the terminal body by the battery 191, may be formed at the rear case 102 or one side surface of the frame 185.

An antenna module may be formed at an upper end or a lower end of the mobile terminal.

Generally, at an upper end of the mobile terminal, an LTENVCDMA Rx Only antenna, a GPS antenna, a BT/WiFi antenna, and the like are provided, and a main antenna is formed at a lower end of the mobile terminal.

An embodiment of the present invention mainly relates to a main antenna, but is not limited thereto and may receive at least one frequency band among the LTE/WCDMA Rx Only antenna, the GPS antenna, and the BT/WiFi antenna.

Further, the antenna module is formed in plural and disposed at each end of the mobile terminal, and also may be formed to receive radio signals of different frequency bands.

The frame 185 may be formed of a metallic material so as to have a sufficient strength despite a small thickness. The frame 185 formed of a metallic material may be operated as a ground. That is, the circuit board 181 or the antenna module 200 may be grounded to the frame 185, such that the frame 185 may be operated as a ground of the circuit board 181 or the antenna module 200. In this instance, the frame 185 may extend a ground of the mobile terminal.

When the circuit board 181 occupies most of an area of the terminal body without providing the frame 185, it is possible to extend the ground by the circuit board 181 by itself.

The circuit board 181 is electrically connected with the antenna module 200 to process radio signals (or radio electromagnetic wave) received and transmitted by the antenna module 200. To process the radio signals, a plurality of transmission/reception circuits 182 may be mounted or formed on the circuit board 181.

The transmission/reception circuits may include more than one integrated circuit and related electrical devices. As an example, the transmission/reception circuit may include a transmission integrated circuit, a reception integrated circuit, a switching circuit, an amplifier, and the like.

The plurality of transmission/reception circuits simultaneously supply an electric power to the conductive members which are radiators, so that the plurality of antenna modules may be simultaneously operated. For instance, while one transmits, another may receive, or both of them may transmit or receive simultaneously.

The transmission/reception circuits may be formed in plural, and each of the transmission/reception circuits may be embodied in the form of a communication chip which includes at least one of a call processor (CP), a Modem chip, an RF transceiver chip, and an RF receiver chip. Thus, each communication chip supplies an electric power to the conductive members through an electric power supply unit and a matching module (including a variable switch) to transmit radio signals, or may execute a predetermined process such as a frequency conversion process or a demodulation process by receiving radio signals received by the conductive members through a matching module (including variable switches) and a feeding portion.

Coaxial cables 183 and 184 are configured to connect the circuit board 181 and the antenna module 200 to each other. As an example, the coaxial cables 183 and 184 may be connected to a feeding device that supplies an electric power to the antenna module 200.

Figure 3:
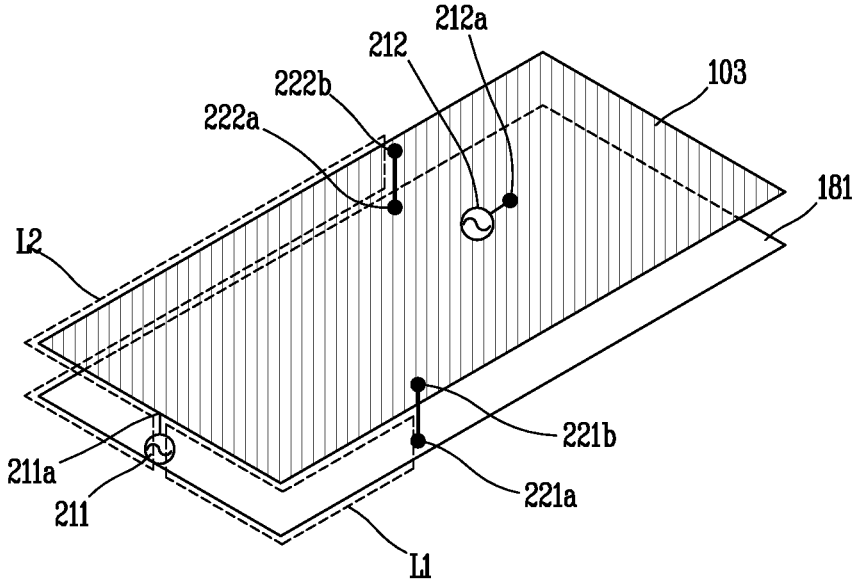
FIG. 3 is a view schematically illustrating a configuration of an antenna module according to an embodiment of the present invention.
Figure 4A:
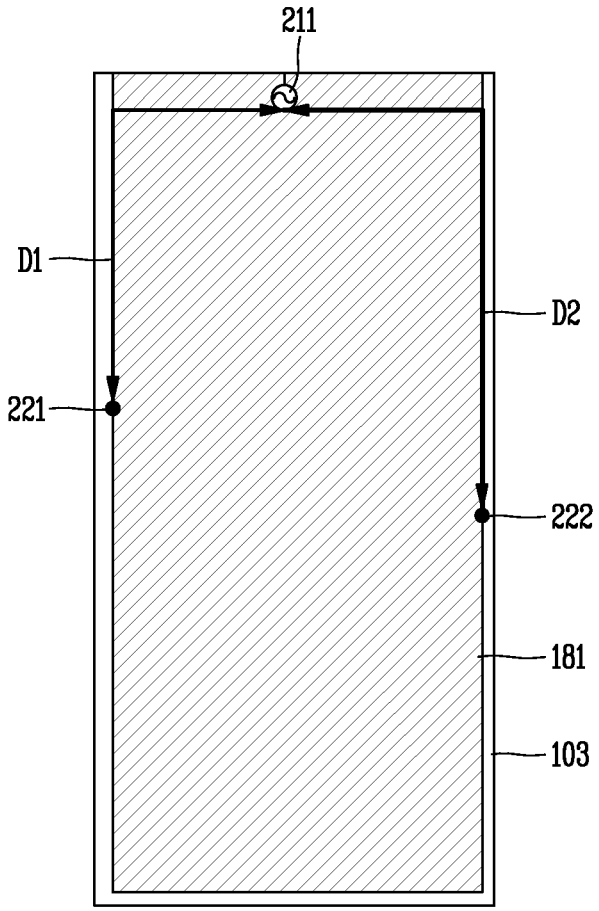
FIG. 4A is a planar view of FIG. 3, and FIGS. 4B and 4C are unfolded views illustrating that a metal plate of FIG. 3 is extended to the left and right, respectively.
Figure 4B:
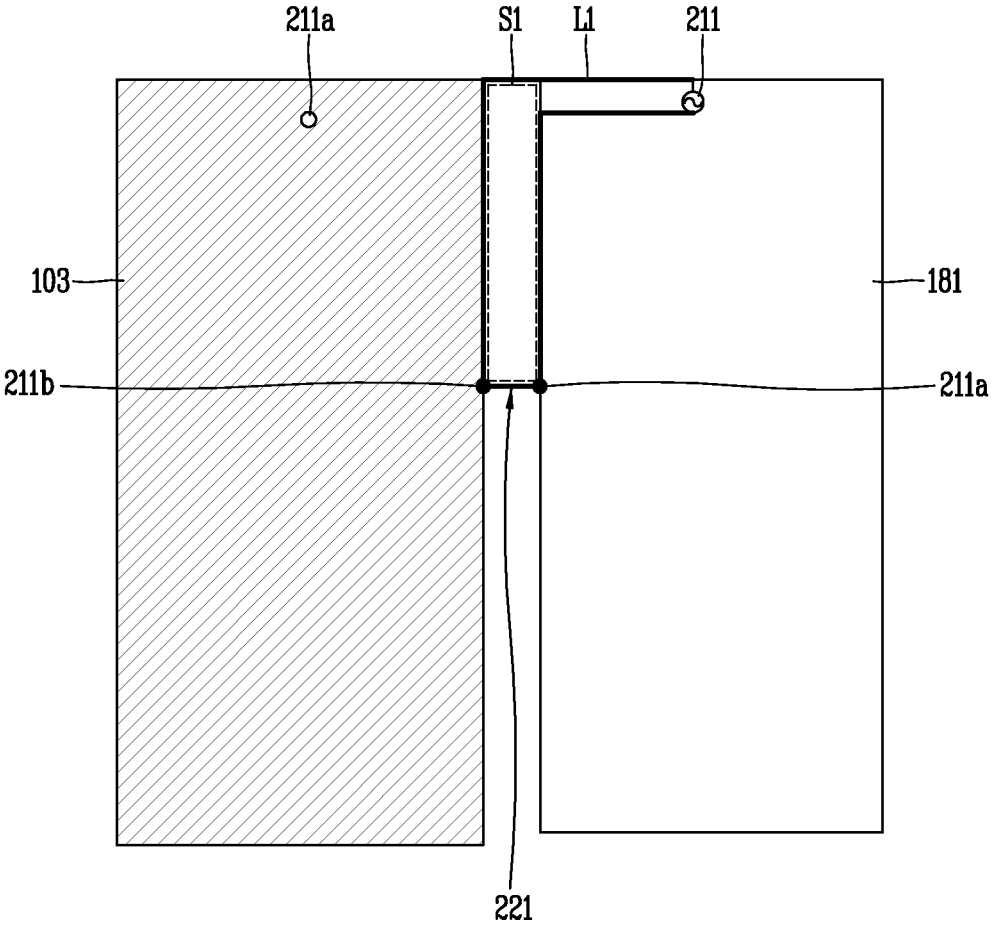
Figure 4C:
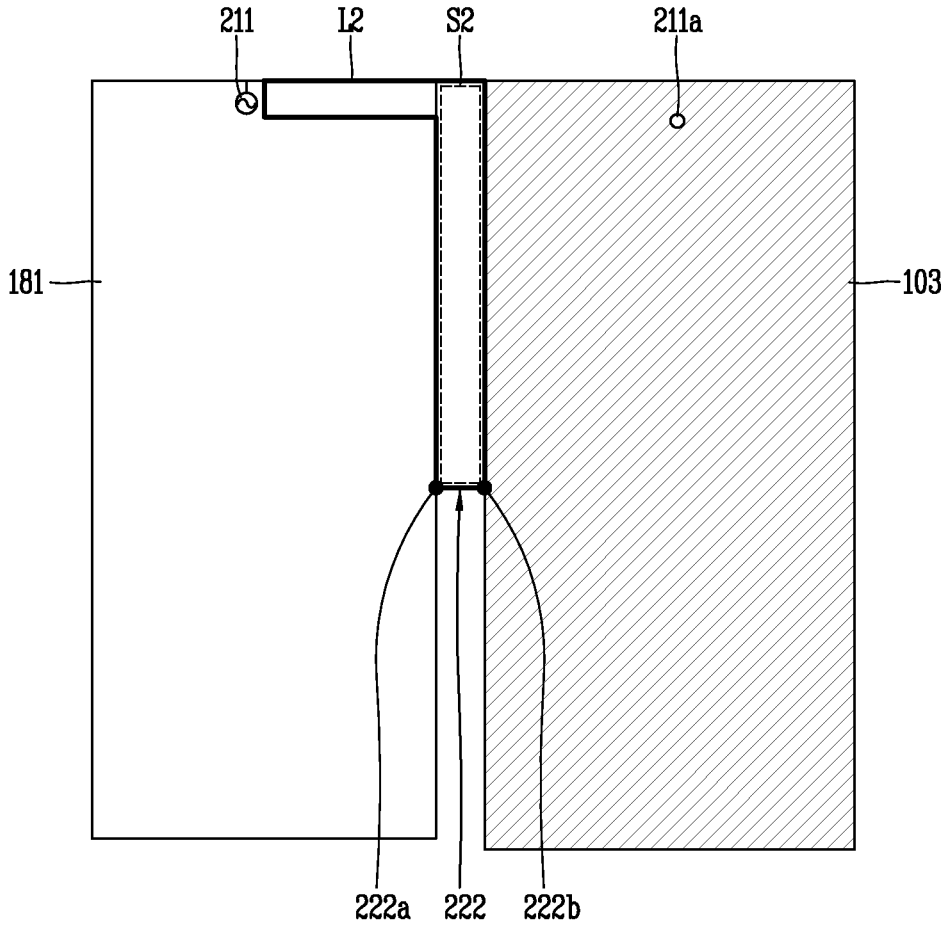

FIG. 3 is a view schematically illustrating a configuration of an antenna module according to an embodiment of the present invention. FIG. 4A is a plane view of FIG. 3, and FIGS. 4B and 4C are unfolded views illustrating that a metal plate of FIG. 3 is extended to the left and right, respectively.

Referring first to FIG. 3, the antenna module 200 according to one embodiment of the present invention includes a ground plate 181, a metal plate 103 spaced apart from the ground plate 181 with a predetermined space in a facing manner, and feeding parts 211 and 212 and ground parts 221 and 222 configured to connect the ground plate 181 and the metal plate 103 to each other.

Here, the ground parts 221 and 222 include a first ground part 221 and a second ground part 222 which are formed along an edge of the ground plate 181, with different distances from the feeding parts 211 and 212.

Here, the ground plate may be a printed circuit board or the frame 185 within a terminal body, and the metal plate may be a rear cover of the mobile terminal which covers the terminal body.

As described hereinabove, in the antenna module according to one embodiment of the present invention, it is possible not only to fabricate part of the rear cover 103 as part of the antenna module 103, but to provide a technique to design an antenna in a state that the rear cover has no slots.

That is, according to one embodiment of the present invention, the antenna may be fabricated by forming no separate slots on the metal plate 103 and the ground plate 181.

The first ground part 221 and the second ground part 222 are electrically connected with the metal plate 103.

As shown in FIG. 3, in one embodiment of the present invention, one or two feeding parts 211 and 212 may be formed, but hereinafter, descriptions will be made on an antenna module which is formed by the first feeding part 211. However, a separate conduction loop may be formed by the second feeding part 212 to implement a resonance frequency, and preferably the second feeding part 212 is positioned at an asymmetrical position to the first feeding part 211.

Here, a first loop L1 is formed by a space from the first feeding part 211 to the first ground part 221, and a second loop L2 is formed by a space from the first feeding part 211 to the second ground part 222. More specifically, the first ground part 221 includes a pair of contact terminals 221*a* and 221*b* which are configured to ground the metal plate 103, and similarly, the second ground part 222 includes a pair of contact terminals 222*a* and 222*b* which are configured to ground the metal plate 103 to the ground plate 181.

Further, the first feeding part 211 is configured to ground the metal plate 103 by the contact terminal 211*a*, and the second feeding part 212 is configured to ground the metal plate 103 by the contact terminal 212*a*. As all feeding parts to be explained later are configured to ground the terminals similarly to the aforementioned detailed descriptions about other feeding parts will be omitted for clarity purposes.

As shown in FIG. 3, the first loop L1 is formed from the first feeding part 211 toward the contact terminal 221*a* of the first ground part 221 along an edge of the ground plate 181 closer to the first ground part 221. Then, the first loop L1 is formed from the contact terminal 221*a* toward the contact terminal 211*a* via the contact terminal 221*b* along an external edge of the metal plate 103, and up to the first feeding part 211.

Further, the second loop L2 is formed in an opposite direction to the first loop L1. That is, the second loop L2 is formed from the first feeding part 211 in a direction closer to the second ground part along an edge of the ground plate 181. Then, the second loop L2 is formed toward the contact terminal 212*a* via the contact terminals 222*a* and 222*b* along an edge of the metal plate 103, and up to the second feeding part 212.

Here, since the first and second ground parts 221 and 222 are differently distant from the first feeding part 211 from each other, a length of the antenna may be different. For instance, as shown in FIG. 4A, when a distance (D1) from the first feeding part 211 to the first ground part 221 is shorter than a distance (D2) from the first feeding part 211 to the second ground part 222, it is possible to implement a resonance frequency of a lower frequency band by the first loop (L1) and a resonance frequency of a higher frequency band by the second loop (L2). Assuming that the second feeding part 212 is formed at one portion of the ground plate 181 and at an asymmetrical point to the first feeding part 211, a different conduction loop is formed by the second feeding part 212 and the first and second ground parts 221 and 222, so that it is possible to implement a resonance frequency of a different frequency band. As described above, when the second feeding part 212 is asymmetrically formed to the first feeding part 211, a resonance of a multi-frequency band can be obtained.

As the ground plate 181 and the metal plate 103 may be electrically connected to each other on a region besides the first and second ground parts 221 and 222, the ground part of one embodiment of the present invention is not limited to the first and second ground parts 221 and 222. That is, a plurality of ground parts are required to manufacture a mobile terminal in a factory, the metal plate 103 and the ground plate 181 may be grounded through such ground parts.

As shown in FIG. 4B, a first slot S1 is formed between the ground part 181 and the metal plate 103, and a second slot S2 is formed between the ground part 181 and the metal plate 103. As described above, in one embodiment of the present invention, the slots S1 and S2 are formed in order to increase a length of the antenna to implement a resonance frequency of a low frequency band in a mobile terminal having a narrow space. This is different from that a slot is formed on the ground plate 181 or the metal plate 103.

The first loop L1 and the second loop L2 may be formed to have a structure of a loop patch or a monopole patch.

Further, the first and second feeding parts 211 and 212 are disposed at upper and lower portions of the ground plate 181, respectively, and at least one of the first and second feeding parts 211 and 212 may be formed at an edge of the ground plate 181. That is, as shown in FIG. 3, the first feeding part 211 is formed around the edge of the ground plate 181, but is not limited thereto and may be formed within the ground plate 181. This may be applicable to the second feeding part 212.

Here, it is possible to obtain a resonance frequency by asymmetrically forming not only the first and second feeding parts 211 and 212, but the first and second ground parts 221 and 222 to each other.

Figure 5:
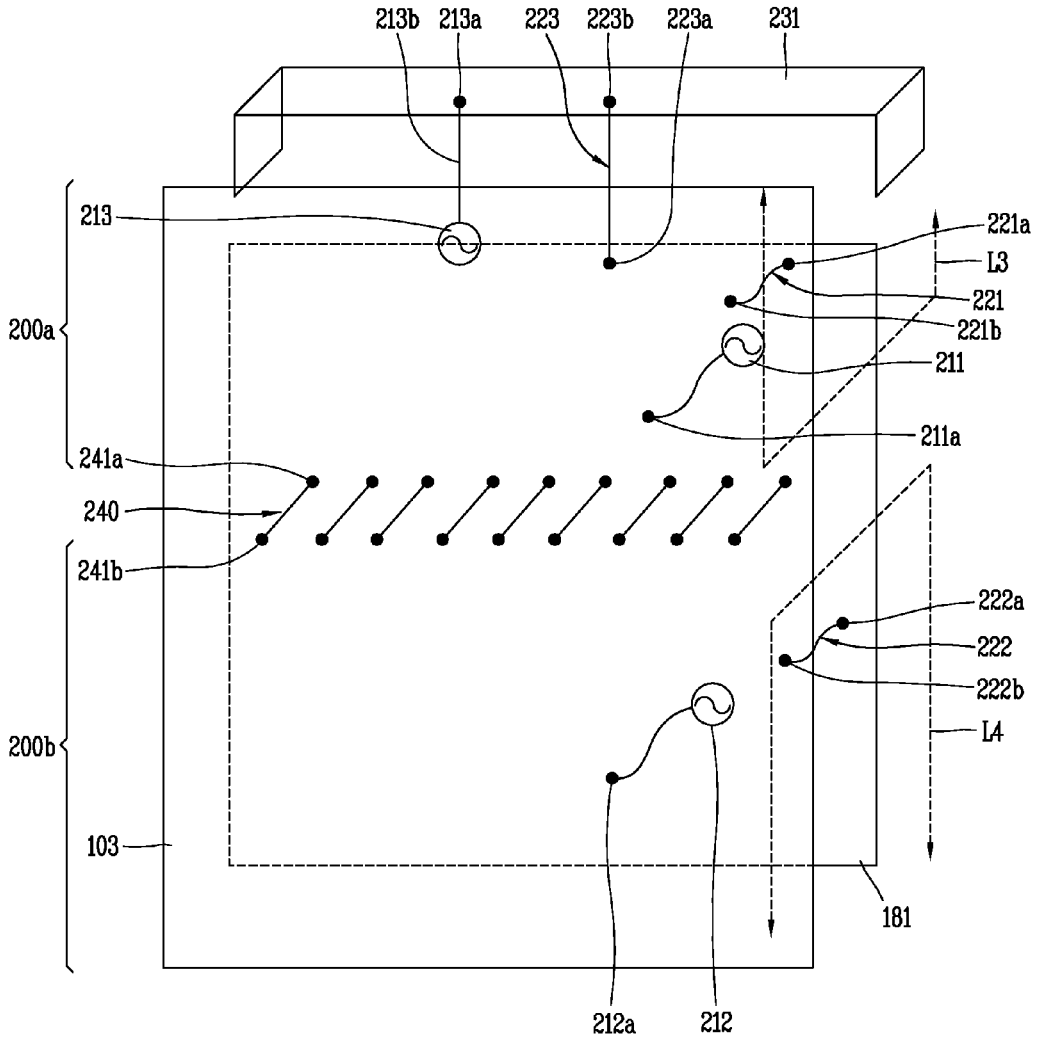
FIG. 5 is a view schematically illustrating a configuration of the antenna module according to one embodiment of the present invention.

FIG. 5 is a view schematically illustrating a configuration of the antenna module according to one embodiment of the present invention.

Referring to FIG. 5, the ground plate 181 and the metal plate 103 are isolated into a first part 200*a* and a second part 200*b* by a cutoff member 240, and at the first and second parts 200*a* and 200*b*, the first feeding part 211 and the first ground part 221 and the second feeding part 212 and the second ground part 222 are formed, respectively.

That is, the ground plate 181 and the metal plate 103 are divided into two regions 200*a* and 200*b* by the cutoff member 240, and the first region 200*a* and the second region 200*b* are electrically insulated from each other. The cutoff member 240 includes a plurality of contact terminals 241*a* and 241*b* which are formed on the ground plate 181 and the metal plate 103. Since an electric current flows along an edge of the ground plate 181 and the metal plate 103, an electric current cutoff effect is relatively high by the contact terminals 241*a* and 241*b* which are formed on a region close to an edge of the ground plate 181 and the metal plate 103. However, in a case where a distance between the first feeding part 211 and the second feeding part 212 is long, since an electric cutoff effect is sufficiently generated by itself, the contact terminals 241*a* and 241*b* may not be additionally required.

Further, the antenna module 200 according to one embodiment of the present invention, as shown in FIG. 5, may further include a conductive member 231 spaced apart from the ground plate 181, a third feeding part 213 formed on the ground plate 181 and configured to feed the conductive member 231, and a third ground part 223 formed on the ground plate 181 and configured to ground the conductive member 231.

By further providing the conductive member 231, it is possible to implement a frequency band for GPS and BT/WiFi. That is, in the antenna module 200 according to one embodiment of the present invention, a resonance frequency is implemented by a current flowing along an edge of the ground plate 181 and the metal plate 103, so that a frequency bandwidth which can be implemented may not be large. Thus, the conductive member 231 is added to solve such a problem.

Here, the metal plate 103 may be fed by the first feeding part 211 and the second feeding part 212 by either a direct feeding method or an indirect feeding method. The direct feeding method is to directly feed an electric current to the metal plate 103 via a cable or the like, and the indirect feeding method is to feed the metal plate 103 in a state that the first or second feeding part 211 or 212 is not directly connected to the metal plate 103, which means a feeding method by an electromagnetic coupling.

Figure 6A:
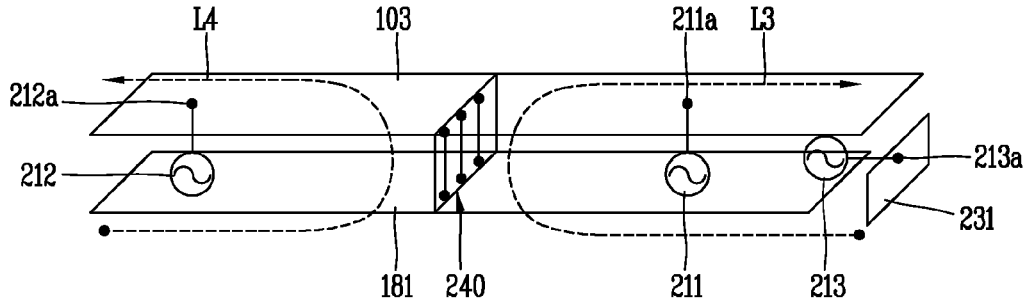
FIG. 6A through 6C are views illustrating an indirect feeding method of FIG. 5.
Figure 6B:
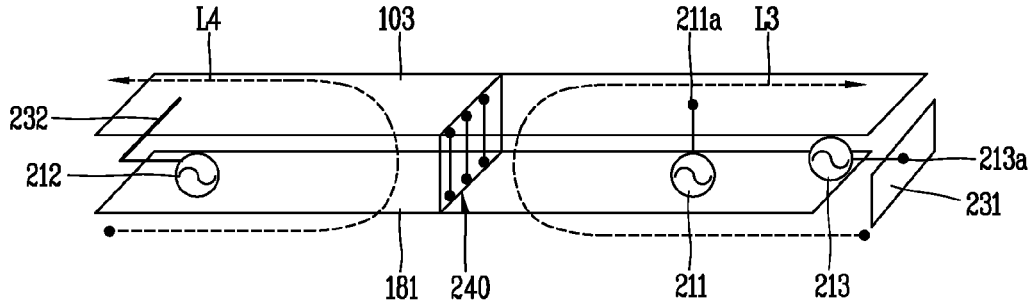
Figure 6C:
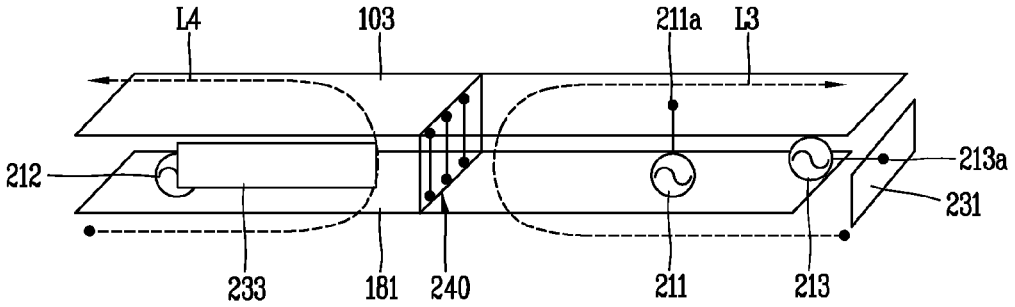

FIG. 6A through 6C are views illustrating an indirect feeding method of FIG. 5, in which FIG. 6A is a view illustrating a direct feeding method, and FIGS. 6B and 6C are views illustrating an indirect method. In FIG. 6A, there is shown that a current is directly applied to the contact terminals 211*a* and 212*a* of the metal plate 103 by a cable. Further, in FIG. 6B, there is shown that a current is directly fed to a conductive line 232 formed on the second feeding part 212, and the metal plate 103 is indirectly fed by radiation patterns by the conductive line 232. FIG. 6C shows that a current is applied to a patch 233 and an inverted L-type antenna is implemented by the patch 233, so that the metal plate 103 is indirectly fed by the radiation patterns of the inverted L-type antenna. Since an impedance matching may be variable by a direction of the patch 233 in FIG. 6C, it is preferable to dispose the patch in a direction where an impedance matching is implemented better.

When the metal plate 103 is fed by an indirect method, it is possible not only to implement a resonance frequency that is higher than a resonance frequency by a loop by a self-resonance, but to feed more broadly.

Further, as shown in FIGS. 5 and 6A through 6C, a third loop L3 and a fourth loop L4 are formed on the metal plate 103 and the ground plate 181, respectively, by the cutoff member 240, so as to implement a resonance frequency.

Figure 7:
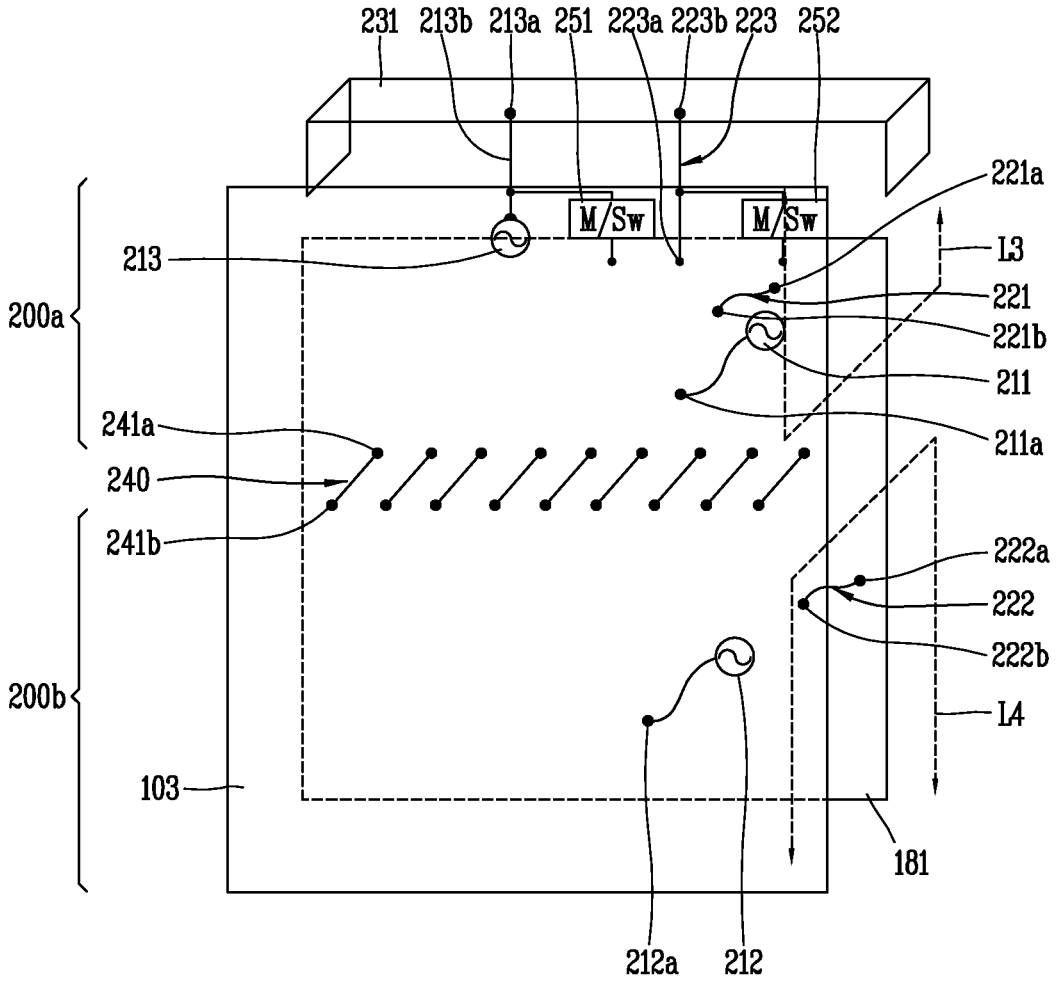
FIG. 7 is a view schematically illustrating a configuration of the antenna module of FIG. 5 to which a matching module is added.

FIG. 7 is a view schematically illustrating a configuration of the antenna module 200 of FIG. 5 to which matching modules 251 and 252 are added.

As shown in FIG. 7, in an antenna module according to one embodiment of the present invention, matching modules 251 and 252 may be formed at the third feeding part 213 and the third ground part 223, respectively, to more smoothly execute an impedance matching.

More specifically, the third feeding part 213 is connected to the contact terminal 213*a* through the conductive line 213*b*, the first matching module 251 is connected to the conductive line 213*b*, and the third ground part 223 is connected to the pair of contact terminals 223*a* and 223*b*. Here, if the pair of the contact terminals 223*a* and 223*b* are connected to each other by the conductive line 223, the second matching module 252 is connected to the conductive line 223. However, in a case where the pair of the contact terminals 223*a* and 223*b* are pogo pins, C-clips, and the like, the second matching module 252 is connected to the contact terminal 223*a*.

Figure 8:
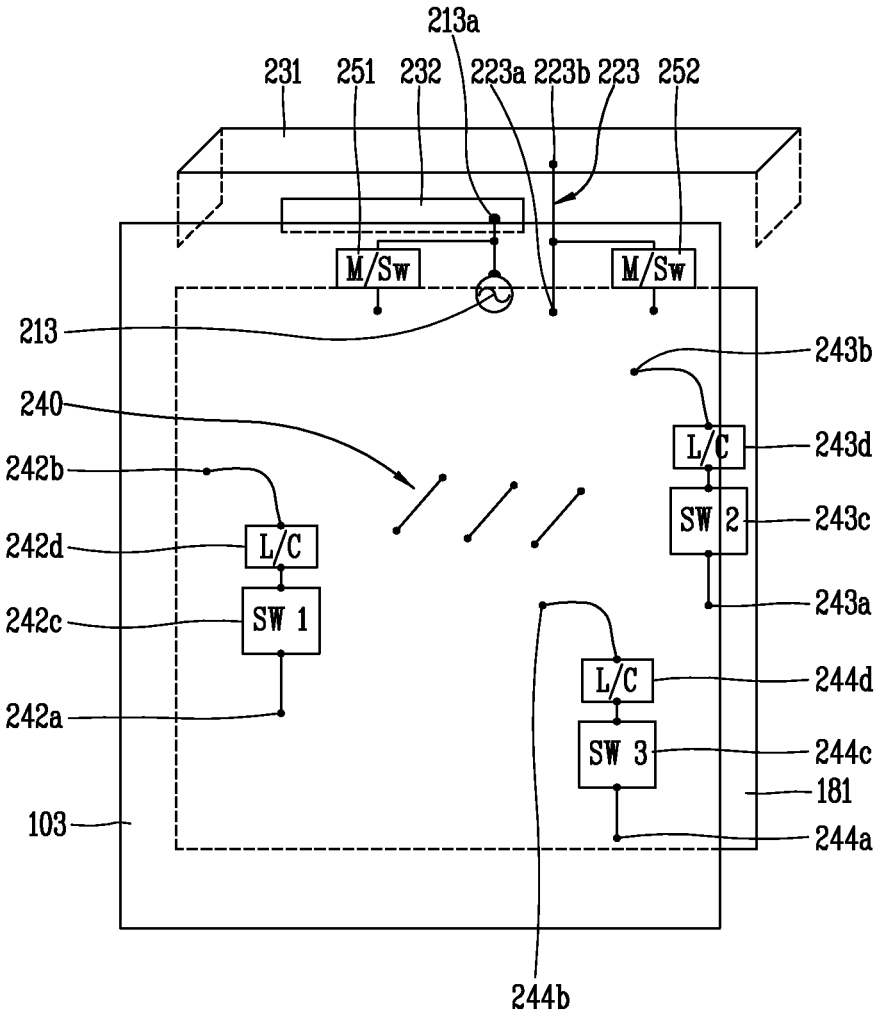
FIG. 8 is a view schematically illustrating a configuration of the antenna module according to an embodiment of the present invention.

FIG. 8 is a view schematically illustrating a configuration of the antenna module 200 according to an embodiment of the present invention, in which the conductive member 231 is fed by an indirect method. That is, the antenna module includes a conductive member 231 spaced apart from the ground plate 181, a second conductive member 232 disposed between the conductive member 231 and the ground plate 181 and configured to indirectly feed the conductive member 231, a third feeding part 213 formed at the ground plate 181 and configured to feed the second conductive member 232, and a third ground part 223 formed at the ground plate 181 and configured to ground the second conductive member 231. In the antenna module 200 of FIG. 5, the third feeding part 213 feeds the conductive member 231. On the contrary, in FIG. 8, the third feeding part 213 is configured to feed the second conductive member 232. The conductive member 231 may be formed within the mobile terminal 100. That is, the conductive member 231 shown in FIG. 5 may form part of a side surface of the mobile terminal 100.

The second conductive member 232 is directly fed by the third feeding part 213, but a feeding method to the metal plate 103 by the second conductive member 232 is an indirect feeding method by an electromagnetic coupling. At this time, matching modules 251 and 251 may be formed at the third feeding part 213 and the third ground part 223.

Further, the metal plate 103 and the ground plate 181 may be divided into regions by the plurality of contact terminals 241*a* and 241*b*, or an electric length thereof may be adjusted. That is, as shown in FIG. 8, variable devices 242*d*, 243*d* and 244*d* including lumped elements and switches 242*c*, 243*c* and 244*c* are connected to the contact terminals 242*a*, 242*b*, 243*a*, 243*b*, 244*a* and 244*b* so that an impedance matching can be more smoothly performed. In this instance, the switches 242*c*, 243*c* and 244*c* include variable switches.

As described above, according to one embodiment of the present invention, at least part of the first and second ground parts 221 and 222 and the plurality of contact terminals 241*a* and 241*b* may have an electric length thereof variable by the lumped elements.

An electric length of the antenna module may be varied by a formation position of the contact terminals 242*a*, 242*b*, 243*a*, 243*b*, 244*a* and 244*b*, and may be more precisely adjusted by the variable devices 242*d*, 243*d* and 244*d* and the switches 242*c*, 243*c* and 244*c*.

This may be also applied to all ground parts to be explained according to another embodiment.

Figure 9:
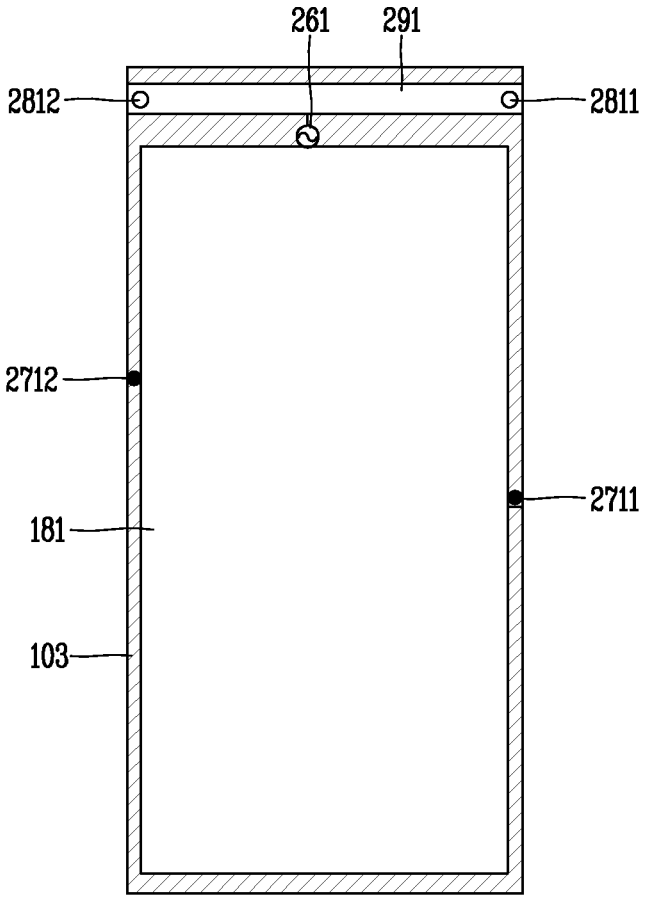
FIG. 9 is a view schematically illustrating a configuration of an antenna module according to another embodiment of the present invention.
Figure 10A:
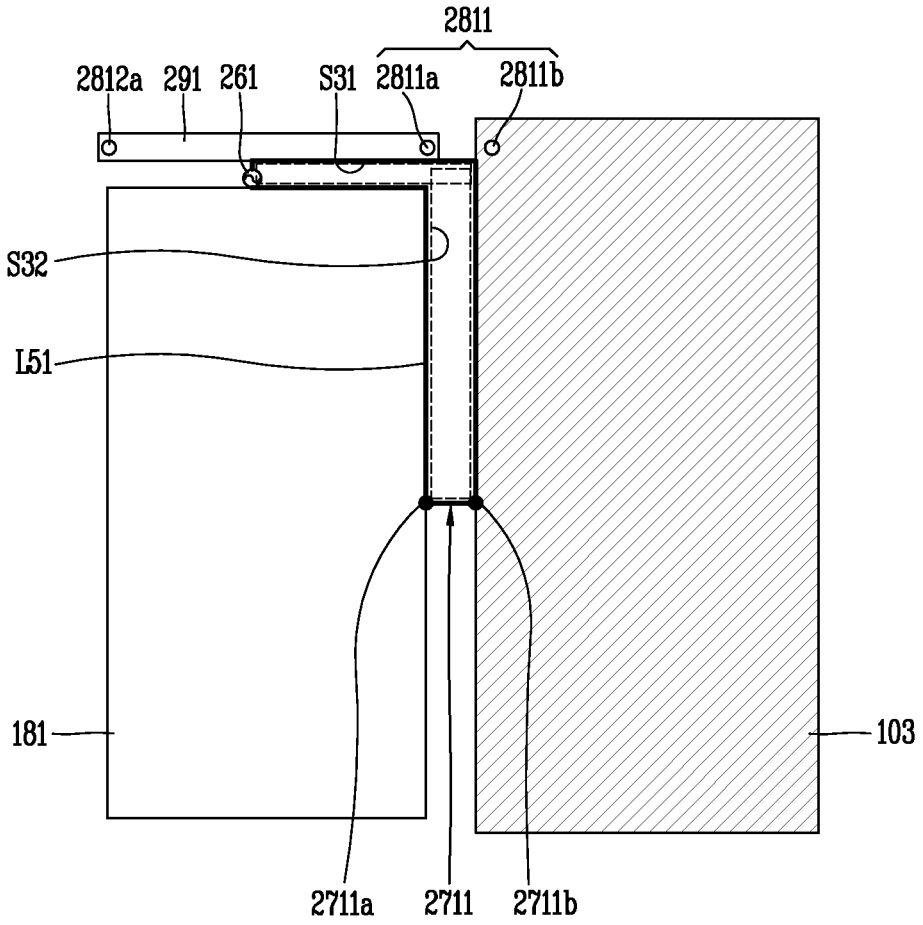
FIGS. 10A and 10B are views illustrating that a ground plate and a metal plate of FIG. 9 are unfolded.
Figure 10B:
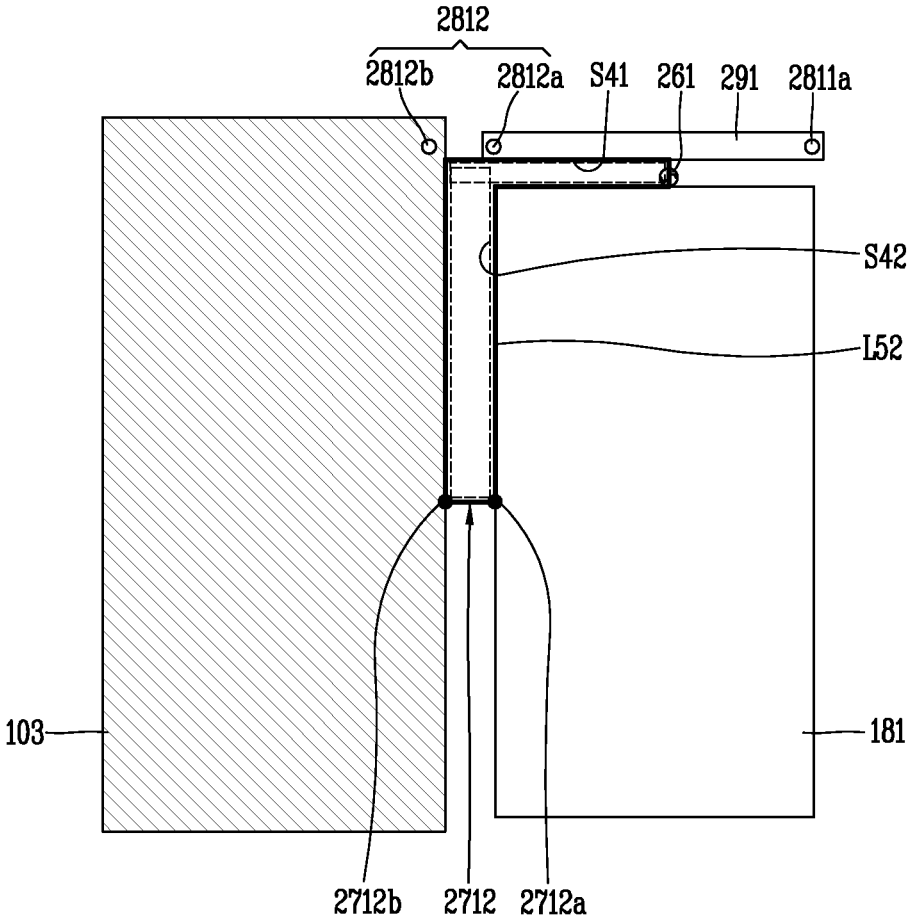

FIG. 9 is a view schematically illustrating a configuration of an antenna module according to another embodiment of the present invention, and FIGS. 10A and 10B are views illustrating that the ground plate 181 and the metal plate 103 of FIG. 9 are unfolded.

Hereinafter, an antenna module 200 according to a second embodiment of the present invention will be described with reference to FIG. 9 and FIGS. 10A and 10B.

Referring to FIG. 9 and FIGS. 10A and 10B, the antenna module 200 according to the second embodiment of the present invention includes a ground plate 181, a conductive member 291 formed at one side of the ground plate 181, and a metal plate 103 spaced apart from the ground plate 181 and the conductive member 291 in a facing manner. Further, a feeding part 261 and ground parts 2711 and 2712 for forming a conductive loop are formed on the ground plate 181.

Here, the ground parts 2711 and 2712 are formed along an edge of the ground plate 181 with different distances from the feeding part 261, like in the aforementioned first embodiment of the present invention.

In this second embodiment, no slot is formed on the metal plate 103, but a slot is formed on the ground plate 181. The slot will be more specifically described with reference to FIGS. 10A and 10B. As shown in FIG. 10A, a third slot S31 is formed between the ground plate 181 and the conductive member 291, and a fourth slot S32 is formed between the ground plate 181 and the metal plate 103. The third slot S31 and the fourth slot S32 form a fifth loop L51.

Here, the fourth slot S32 formed between the ground plate 181 and the metal plate 103 is formed by separating the ground plate 181 and the metal plate 103 from each other, and is different from the third slot S31. The ground plate 181 and the conductive member 291 may be electrically connected to each other, and may not be electrically connected.

Further, the conductive member 291 and the metal plate 103 are electrically connected to each other on at least one portion, and an area of the ground plate 181 is smaller than that of the metal plate 103. For instance, the metal plate 103 may be configured to cover the ground plate 181 and the conductive member 291.

As described above, in the second embodiment of the present invention, an electrical connection between the metal plate 103 and the conductive member 291 has to be implemented to form a conductive loop.

In FIG. 10A, an electric current is formed from the feeding part 261 along an edge of the ground plate 181 toward the ground pare 2711, is formed at the metal plate 103 by the contact terminals 2711*a* and 2711*b* of the ground part 2711, is formed up to the conductive member 291 by the contact terminals 2811 (2811*a* and 2811*b*) along an edge of the metal plate 103, and thereafter is formed up to a portion from the conductive member 291 to the feeding part 261. In this instance, in FIG. 10A, the conductive member 291 and the ground plate 181 may be separated from each other, and partially connected to each other by a protrusion that is protruded from the conductive member 291 or the ground plate 181 (refer to FIG. 15 and FIG. 16).

Further, referring to FIG. 10B, there is shown a fifth loop L52, which is formed by a fifth slot S41 formed between the ground plate 181 and the conductive member 291 and a sixth slot S42 formed between the ground plate 181 and the metal plate 103.

Here, the third slot S31 and the fifth slot S41 are the same in that they are formed between the ground plate 181 and the conductive member 291, but are different from each other in that they are formed on the right and left of the feeding part 261.

The fifth loop L52 of FIG. 10B is formed along an edge of the ground plate 181 from the feeding part 261 toward the ground part 2712, is formed at the metal plate 103 by the contact terminals 2712*a* and 2712*b* of the contact terminal 2712, is formed to the conductive member 291 along an edge of the metal plate 103 by the contact terminals 2812 (2812*a* and 2812*b*), and thereafter is formed up to a portion from the conductive member 291 to the feeding part 261. In this instance, the conductive member 291 and the ground plate 181 may be separated from each other, and partially connected to each other by a protrusion that is protruded from the conductive member 291 or the ground plate 181 (refer to FIG. 15 and FIG. 16).

Figure 11:
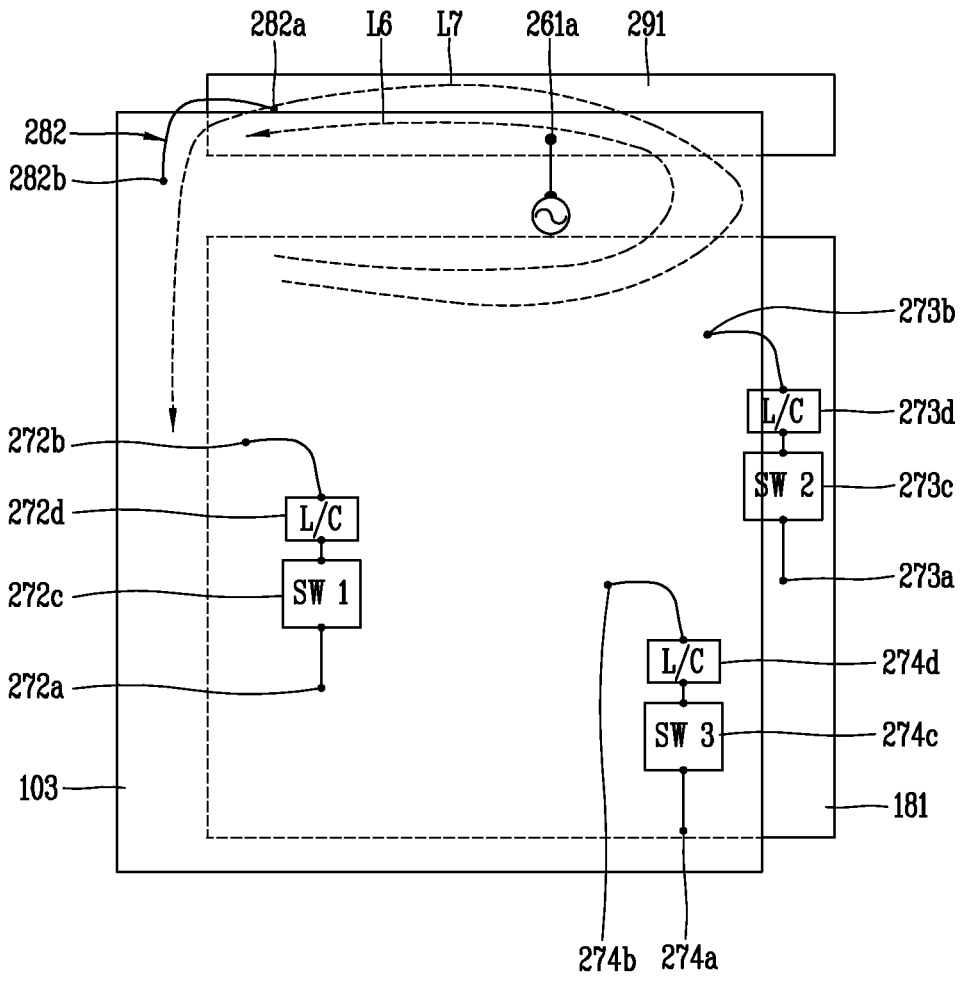
FIG. 11 is a view schematically illustrating a configuration of the antenna module according to another embodiment of the present invention.

FIG. 11 is another view schematically illustrating a configuration of the antenna module 200 according to one embodiment of the present invention.

Referring to FIG. 11, the ground part 271 is connected to the variable devices 272*d*, 273*d* and 274*d* including lumped elements and the switches 272*c*, 273*c* and 274*c* (including variable switches). Here, contact terminals 272*a*, 273*a* and 274*a* are formed at the ground plate 181, and the contact terminals 272*c*, 273*c* and 274*c* are formed at the metal plate 103. It is possible to control a current flowing direction at the antenna module 200 by forming the contact terminals 272*a*, 273*a*, 274*a*, 272*b*, 273*b* and 274*b* at a plurality of portions, and an electric length of the antenna module 200 can be more precisely varied by the variable devices 272*d*, 273*d* and 274*d* and the switches 272*c*, 273*c* and 274*c*. Here, varying the electric length means controlling a direction and an intensity of an electric current at the conductive member 291, the metal plate 103 and the ground plate 181. For instance, as shown in FIG. 5, it is possible to cutoff a current or control a current direction by forming the plurality of contact terminals 241*a* and 241 *b* at a predetermined region, or at a plurality of regions one by one.

FIG. 11 is a view schematically illustrating a configuration of the antenna module 200, in which a sixth loop L6 and a seven loop L7 are shown, according to another embodiment of the present invention.

The six loop L6 has a conduction path which is formed from the feeding part 261 to the contact terminal 261*a* along the conductive member 291, and the seventh loop L7 has a conduction path which is formed from the feeding part 261 to the metal plate 103 by the contact terminals 282*a* and 282*b* along the conductive member 291 via the contact terminal 261*a*.

Figure 12A:
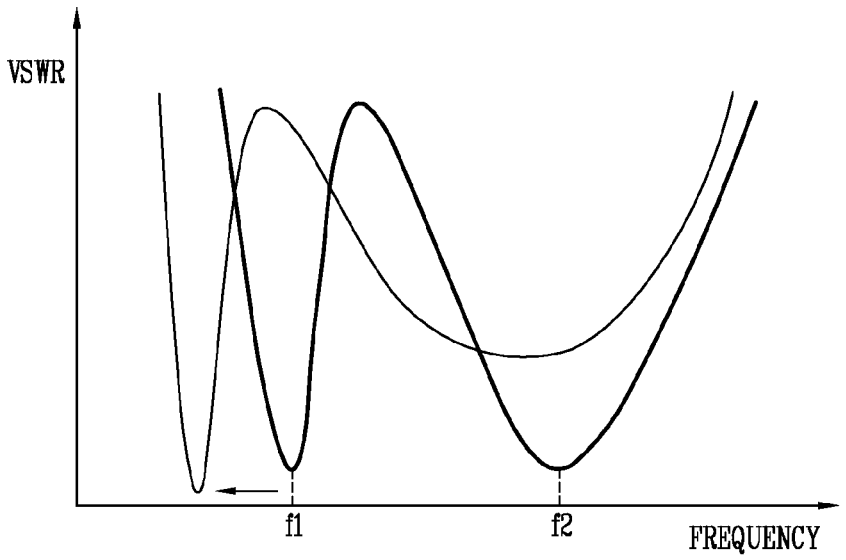
FIGS. 12A and 12B are graphs illustrating a voltage standing wave ratio (VSWR) according to a frequency of FIG. 11.
Figure 12B:
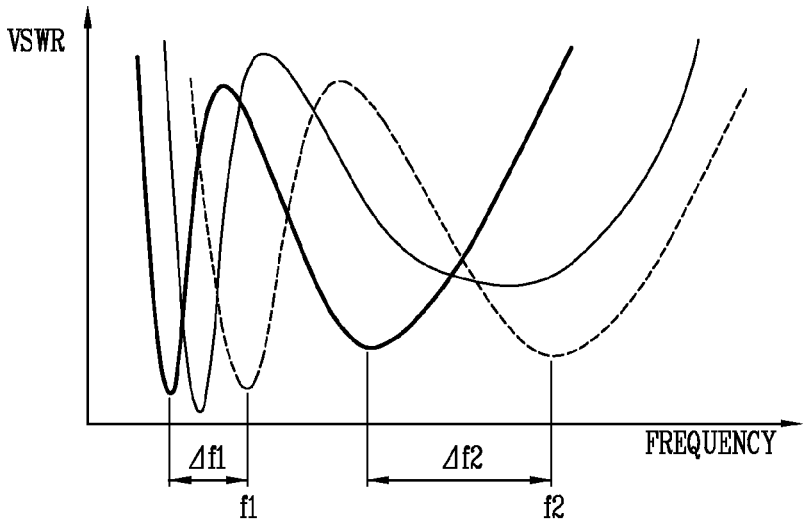

Meanwhile, FIGS. 12A and 12B are graphs illustrating a voltage standing wave ratio (VSWR) according to a frequency of FIG. 11. In FIG. 12A, the thick real line indicates a graph that the metal plate 103 is not provided, and the thin real line indicates a graph that the metal plate 103 is provided. In FIG. 12B, the dotted line indicates a graph that the metal plate 103 is not provided, and the thin and thick lines indicate that the metal plate 103 is provided. FIG. 12B shows a case that an electric length is varied by the variable devices 272*d*, 273*d* and 274*d* and the switches 272*c*, 273*c* and 274*c*. Here, assuming that resonance points in a case that the metal plate 103 is not provided are f1 and f2, respectively, as shown in FIG. 12A, the resonance point at a low frequency is shifted when the metal plate 103 is provided. Thus, it may be noticed that it is possible to implement a frequency of a lower bandwidth. Further, as shown in FIG. 12B, it may be noticed that the resonance points can be moved by Δf1 and Δf2, not only at the high resonance frequency f2, but also at the low resonance frequency f1, as an electric length is varied by using the variable devices 272*d*, 273*d* and 274*d* and the switches 272*c*, 273*c* and 274*c*.

That is, referring to FIG. 12A, it may be noticed that a resonance point at a low frequency is shifted in a case where the metal plate 103 is used as part of the antenna module 200, and referring to FIG. 12B, it may be noticed that it is possible to control a resonance frequency by varying the resonance frequency using the variable devices 272*d*, 273*d* and 274*d* and the switches 272*c*, 273*c* and 274*c*.

In conclusion, it will be noticed that it is possible to implement a resonance frequency of a broader range by using the metal plate 103, the variable devices 272*d*, 273*d* and 274*d* and the switches 272*c*, 273*c* and 274*c*.

Figure 13:
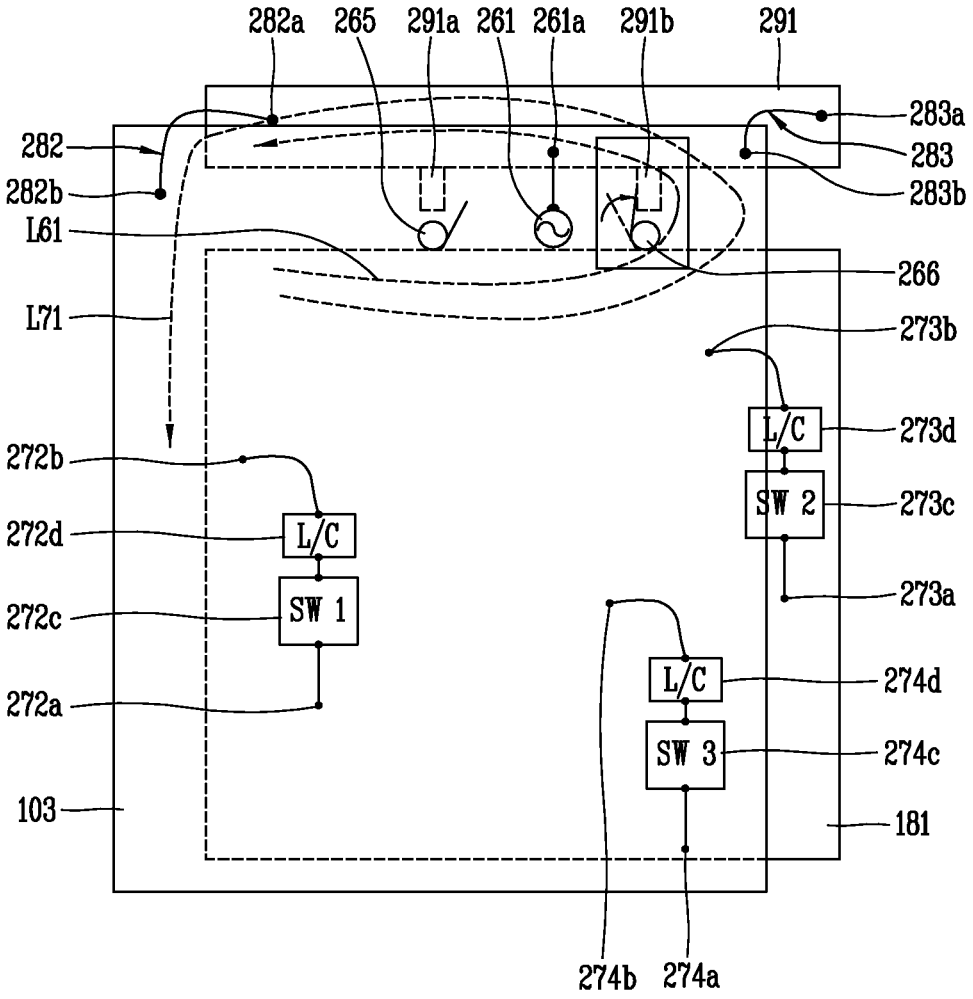
FIGS. 13 and 14 are views schematically illustrating a configuration of an antenna module in which the ground plate and the conductive member according to another embodiment of the present invention are connected to each other by a switch.
Figure 14:
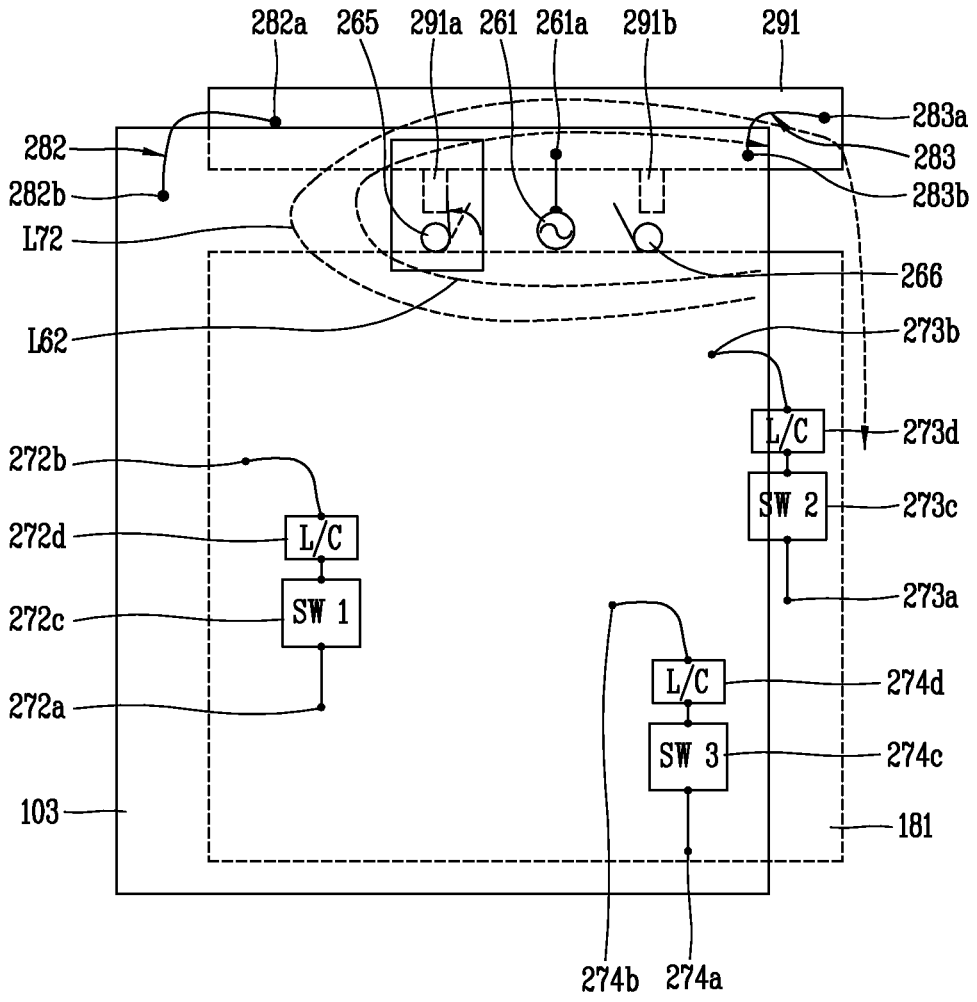

FIGS. 13 and 14 are views schematically illustrating a configuration of an antenna module 200 in which the ground plate 181 and the conductive member 291 according to another embodiment of the present invention are connected to each other by switches 265 and 266.

Referring to FIGS. 13 and 14, it will be noticed that the conductive member 291 and the ground plate 181 are selectively connected to each other by the first and second switches 265 and 266 which are spaced apart from each other. That is, in the second embodiment of the present invention, the conductive member 291 and the ground plate 181 are spaced apart from each other, but are ground-connected at one point thereof and feed-connected at another point thereof. Here, the conductive member 291 and the ground plate 181 have to be not only ground-connected but feed-connected, so that a resonance frequency with a broader bandwidth can be implemented.

According to the second embodiment of the present invention, it is possible to selectively implement at least one of the ground-connection and the feed-connection by the switch. However, in FIG. 13, the conductive member 291 is always fed by the feeding part 261 formed at the ground plate 181, thereby enabling a feed-connection. The first and second switches 265 and 266 are disposed at the ground plate 181 so that one of the first and second switches 265 and 266 is connected to the protrusions 291*a* and 291*b* which are protruded from the conductive member 291, thereby enabling a ground-connection. FIG. 13 shows that the conductive member 291 is grounded by using the second switch 266 which is disposed on the right, and FIG. 14 shows that the conductive member 291 is grounded by using the first switch 265 which is disposed on the left.

As described above, it is possible to adjust a direction of a radiation pattern of an antenna by forming the protrusions 291*b* and 291*c* at portions which are spaced apart from each other, disposing the switches 265 and 266 at portions corresponding to the protrusions 291*b* and 291*c*, and selectively grounding the conductive member 291 at any one portion. For instance, when a user grasps the mobile terminal 100 containing the antenna module 200 therein, it is preferred that in case of grasping the first switch 265, the conductive member 291 is grounded by the second switch 266, and in case of grasping the second switch 266, the conductive member 291 is grounded by the first switch 265. This is to minimize an influence on a radiation pattern by a human body such as a users hand. That is, in order to minimize an influence by a human body, a direction of an electric current flow is adjusted so that a body effect or a hand effect can be minimized.

In this instance, an impedance matching is well performed and a resonance point of a resonance frequency is shifted at the ground plate 181 by the variable devices 272*d*, 273*d* and 274*d* and the variable switches 272*c*, 273*c* and 274*c*.

In FIG. 13, a sixth loop L61 and a seventh loop L71 are formed by connecting the second switch 266, as shown in FIG. 11, whereas, in FIG. 14, the sixth and seventh loops L62 and L72 are formed in an opposite direction to that in FIG. 13 by connecting the first switch 265. In this instance, the conductive member 291 and the metal plate 103 are ground-connected by the contact terminals 282*a*, 282*b*, 283*a* and 283*b*.

Figure 15:
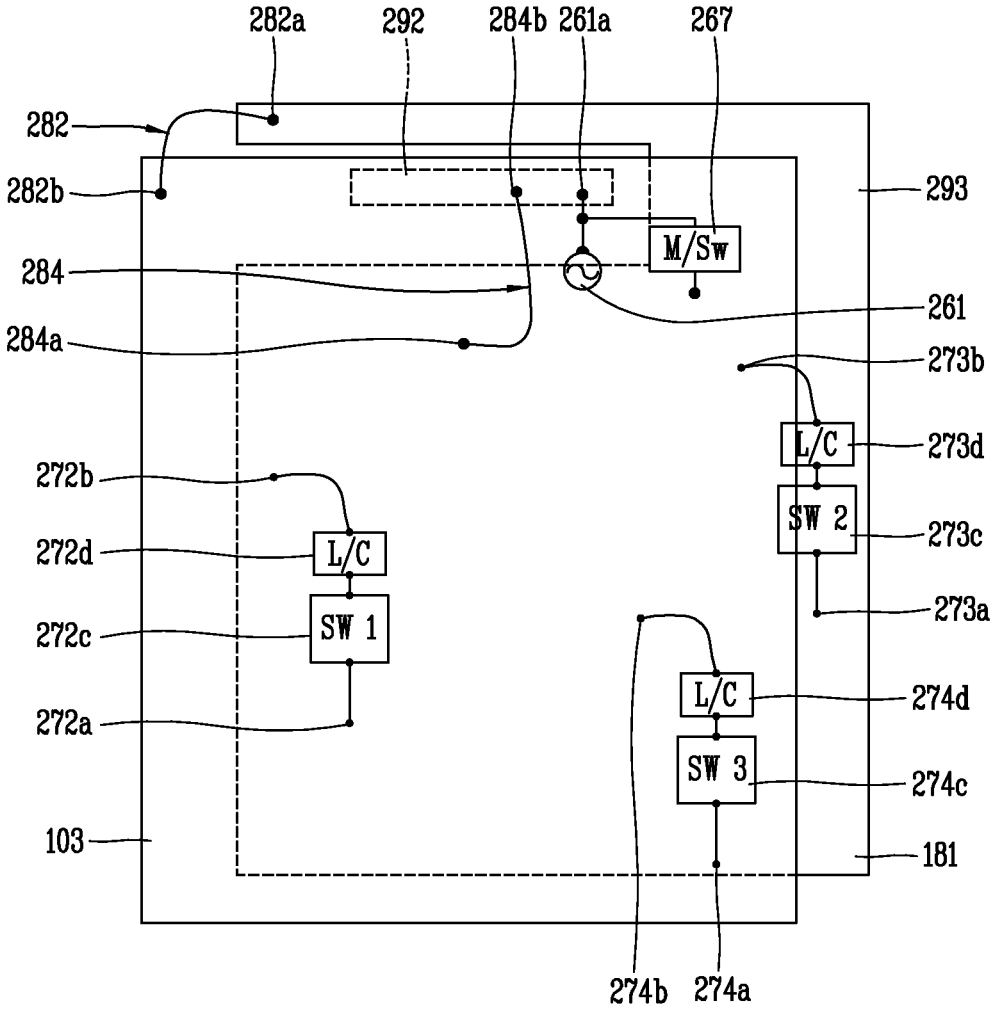
FIG. 15 is a view schematically illustrating a configuration of the antenna module of FIG. 11 to which a second conductive member is added.

FIG. 15 is a view schematically illustrating a configuration of the antenna module 200 of FIG. 11 to which a second conductive member 292 is added.

Referring to FIG. 15, there is shown that a second conductive member 292 is formed between the conductive member 291 and the ground plate 181, the feeding part 261 directly feeds the second conductive member 292, and the second conductive member 292 indirectly feeds the conductive member 291. The second conductive member 292 is ground-connected to the ground plate 181 by the contact terminals 284*a* and 284*b*.

Here, the conductive member 291 and the ground plate 181 are connected to each other by a connection part 293 which may be formed by protruding from the conductive member 291 or the ground plate 181, and the conductive member 291 and the ground plate 181 may be integrally formed. A matching module 267 may be formed at the feeding part 261 for an impedance matching. However, the connection part 293 is not necessarily required, and any member to connect the conductive member 291 and the ground plate 181 to each other may be used.

Figure 16:
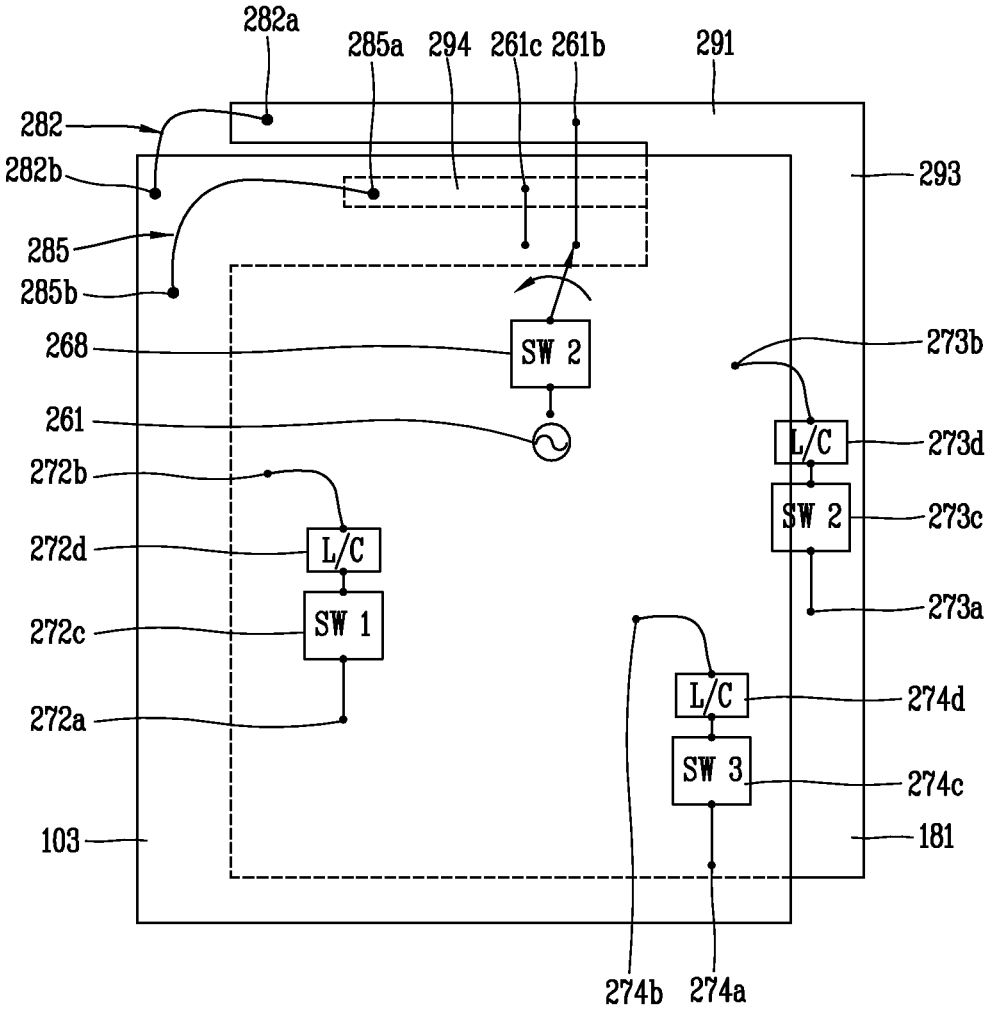
FIG. 16 is a view schematically illustrating a configuration of the antenna module of FIG. 11 to which a protrusion portion is added.

FIG. 16 is a view schematically illustrating a configuration of the antenna module 200 of FIG. 11 to which a protrusion part 294 is added.

Referring to FIG. 16, a protrusion part 294 may be formed at the connection part 293 between the conductive member 291 and the ground plate 181. The protrusion part 294 is electrically connected to the metal plate 103 by contact terminals 285*a* and 285*b*, and a switch 268 is disposed at the feeding part 261 so that the feeding part 261 may be selectively connected to the protrusion part 294 or the conductive member 291. When the feeding part 261 is connected to the protrusion part 294 by the switch 268, the protrusion part 294 is directly fed so that a current flow is formed at the protrusion part 294. On the contrary, when the feeding part 261 is connected to the conductive member 291 by the switch 268, the conductive member 291 is directly fed so that a current flow is formed at the conductive member 291. As described above, in the second embodiment of the present invention, the protrusion part 294 formed at the connection part 293 is provided to change a resonance frequency band by varying a current path. In this instance also, the conductive member 291 and the metal plate 103 are connected to each other on at least one point and the protrusion part 294 is connected to the metal plate 103 on at least one point.

In FIG. 16, since the conductive member 291 and the protrusion part 294 are formed to be close to each other, when one of the conductive member 291 and the protrusion part 294 is directly fed, the other may be indirectly fed. For instance, when the protrusion part 294 is directly fed, a current path is formed at the protrusion part 294 and the conductive member 291 is indirectly fed by the current path formed at the protrusion part 294 so that a current path is also formed at the conductive member 291, thereby implementing an additional resonance frequency. On the contrary, the conductive member 291 is directly fed and the protrusion part 294 is indirectly fed by a current formed at the conductive member 291, so that a current path may be formed at both the protrusion part 294 and the conductive member 291.

Further, the ground plate 181 and the metal plate 103 may be connected to each other on at least one point to control an electric length of an antenna, and the variable devices 272*d*, 273*d* and 274*d* including lumped elements and the switches 272*c*, 273*c* and 274*c* may be connected at the connection point.

Further, in the embodiment of the present invention, a ground-connection may be performed by contact terminals, but may be performed by conductive lines 221, 222, 223, 282, 283, 284 and 285.

Various embodiments may be implemented using a machine-readable medium having instructions stored thereon for execution by a processor to perform various methods presented herein. Examples of possible machine-readable mediums include HDD (Hard Disk Drive), SSD (Solid State Disk), SDD (Silicon Disk Drive), ROM, RAM, CD-ROM, a magnetic tape, a floppy disk, an optical data storage device, the other types of storage mediums presented herein, and combinations thereof. If desired, the machine-readable medium may be realized in the form of a carrier wave (for example, a transmission over the Internet). The processor may include the controller 180 of the mobile terminal.

As the present features may be embodied in several forms without departing from the characteristics thereof, it should also be understood that the above-described embodiments are not limited by any of the details of the foregoing description, unless Alternatively specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. An antenna module, comprising:

a ground plate;

a metal plate spaced apart from the ground plate by a distance such that a surface of the ground plate faces a surface of the metal plate;

at least one feeding part and at least one ground part that couple the ground plate to the metal plate; and a cutoff member disposed between the ground plate and the metal plate, wherein the cutoff member comprises a plurality of contact terminals, wherein the ground plate and the metal plate are divided into a first portion and a second portion by the plurality of contact terminals that are disposed along a boundary between the first portion and the second portion, wherein the at least one ground part comprises a first ground part and a second ground part that are formed at two different positions along an edge of the ground plate, wherein the first ground part and the second ground part are spaced apart from the at least one feeding part, wherein the at least one feeding part comprises a first feeding part positioned at an upper portion of the ground plate and a second feeding part positioned at a lower portion of the ground plate, wherein at least one of the first feeding part or the second feeding part is formed at an edge portion of the ground plate, and wherein the first portion includes the first feeding part and the first ground part, and the second portion includes the second feeding part and the second ground part.

2. The antenna module of claim 1, further comprising:

a conductive member spaced apart from the ground plate;

a third feeding part formed on the ground plate to feed the conductive member; and a third ground part formed on the ground plate to ground the conductive member to the ground plate.

3. The antenna module of claim 2, wherein the first feeding part and the second feeding part directly or indirectly feed the metal plate by a conductive line or a patch.

4. The antenna module of claim 2, wherein each of the third feeding part and the third ground part includes a corresponding matching module.

5. The antenna module of claim 1, wherein the plurality of contact terminals are configured to couple the ground plate to the metal plate.

6. The antenna module of claim 5, wherein at least part of the first and second ground parts and the plurality of contact terminals has an electrical length that is variable at the metal plate and the ground plate by a variable device including a lumped element and a switch coupled to the variable device.

7. The antenna module of claim 1, further comprising:

a first conductive member spaced apart from the ground plate;

a second conductive member positioned between the first conductive member and the ground plate to indirectly feed the first conductive member;

a third feeding part formed on the ground plate to feed the second conductive member; and a third ground part formed on the ground plate to ground the second conductive member to the ground plate.

8. The antenna module of claim 7, wherein each of the third feeding part and the third ground part includes a corresponding matching module.

9. An antenna module, comprising:

a ground plate;

a first conductive member formed at one side of the ground plate;

a metal plate spaced apart from the ground plate and the first conductive member by a distance such that a surface of the metal plate faces a surface of the ground plate and a surface of the first conductive member;

a cutoff member disposed between the ground plate and the metal plate, wherein the cutoff member comprises a plurality of contact terminals, and wherein the ground plate and the metal plate are divided into a first portion and a second portion by the plurality of contact terminals that are disposed along a boundary between the first portion and the second portion;

a feeding part formed on the ground plate to feed the first conductive member; and a ground part to ground the metal plate to the ground plate, wherein:

the first conductive member and the metal plate are electrically connected via at least one point;

an area of the ground plate is smaller than an area of the metal plate; and a first slot is formed between the ground plate and the first conducive member, and a second slot is formed between the ground plate and the metal plate.

10. The antenna module of claim 9, wherein the metal plate is shaped to enclose the ground plate and the first conductive member.

11. The antenna module of claim 9, wherein the ground part has an electrical length that is variable by a variable device including a lumped element and a switch coupled to the variable device.

12. The antenna module of claim 9, wherein the first conductive member and the ground plate are coupled to each other via a connection part protruded from the first conductive member or the ground plate.

13. The antenna module of claim 12, wherein:

the connection part includes a protrusion part formed between the first conductive member and the ground plate;

the protrusion part is electrically connected to the metal plate via one point; and the feeding part includes a switch for selectively connecting the feeding part to the protrusion part or the first conductive member.

14. The antenna module of claim 9, wherein the first conductive member and the ground plate are selectively coupled to each other by first and second switches that are spaced apart from each other.

15. The antenna module of claim 9, further comprising a second conductive member formed between the first conductive member and the ground plate, wherein:

the feeding part directly feeds the second conductive member; and the second conductive member indirectly feeds the first conductive member.

16. A mobile terminal, comprising:

a terminal body; and an antenna module provided within the terminal body and comprising:

a ground plate;

a metal plate that is spaced apart from the ground plate by a distance such that a surface of the ground plate faces a surface of the metal plate;

a cutoff member disposed between the ground plate and the metal plate, wherein the cutoff member comprises a plurality of contact terminals, and wherein the ground plate and the metal plate are divided into a first portion and a second portion by the plurality of contact terminals that are disposed along a boundary between the first portion and the second portion; and a feeding part and a ground part that couple the ground plate to the metal plate, wherein the feeding part comprises a first feeding part positioned at an upper portion of the ground plate and a second feeding part positioned at a lower portion of the ground plate, wherein the ground plate comprises a first ground part and a second ground part that are formed at two different positions along an edge of the ground plate, wherein the first ground part and the second ground part are differently distanced from the feeding part, and wherein the first portion includes the first feeding part and the first ground part, and the second portion includes the second feeding part and the second ground part.

17. The mobile terminal of claim 16, wherein the metal plate is a cover shaped to cover the terminal body, and the ground plate is a printed circuit board.

18. The mobile terminal of claim 16, further comprising a conductive member spaced apart from the ground plate, wherein:

the feeding part is formed on the ground plate to feed the conductive member;

the ground part is formed on the ground plate to ground the conductive member to the ground plate; and the conductive member is formed at an inner side of a side surface of the terminal body.

19. A mobile terminal comprising:

a terminal body; and an antenna module provided within the terminal body and comprising:

a ground plate;

a first conductive member formed on one side of the ground plate and electrically connected to the ground plate;

a metal plate spaced apart from the ground plate and the first conductive member by a distance such that a surface of the metal plate faces a surface of the ground plate and a surface of the conductive member;

a cutoff member disposed between the ground plate and the metal plate, wherein the cutoff member comprises a plurality of contact terminals, and wherein the ground plate and the metal plate are divided into a first portion and a second portion by the plurality of contact terminals that are disposed along a boundary between the first portion and the second portion;

a feeding part formed on the ground plate to feed the first conductive member; and a ground part to ground the metal plate to the ground plate, wherein:

the first conductive member and the metal plate are electrically connected via at least one point; and a first slot is formed between the ground plate and the first conductive member, and a second slot is formed between the ground plate and the metal plate.

20. The mobile terminal of claim 19, wherein the metal plate is a cover shaped to cover the terminal body, and the ground plate is a printed circuit board.

21. The mobile terminal of claim 19, wherein the first conductive member and the ground plate are coupled to each other via a connection part protruded from the first conductive member or the ground plate.

22. The mobile terminal of claim 21, wherein:

the connection part includes a protrusion part formed between the first conductive member and the ground plate;

the protrusion part is electrically connected to the metal plate via one point; and the feeding part includes a switch for selectively connecting the feeding part to the protrusion part or the first conductive member.

23. The mobile terminal of claim 19, wherein the first conductive member and the ground plate are selectively coupled to each other by first and second switches that are spaced apart from each other.

24. The mobile terminal of claim 19, wherein:

the antenna module further comprises a second conductive member that is formed between the first conductive member and the ground plate;

the feeding part directly feeds the second conductive member; and the second conductive member indirectly feeds the first conductive member.

* * * * *